US008298071B2

(12) United States Patent
Inamura et al.

(10) Patent No.: US 8,298,071 B2
(45) Date of Patent: Oct. 30, 2012

(54) SLOT MACHINE HAVING A PLURALITY OF INPUT DEVICES AND CONTROL METHOD THEREOF

(75) Inventors: Yukinori Inamura, Tokyo (JP); Kazumasa Yoshizawa, Tokyo (JP); Yoichi Kato, Tokyo (JP); Tatsuya Teranishi, Tokyo (JP); Shinji Ogino, Tokyo (JP); Hiroki Saito, Tokyo (JP); Fumiya Abe, Tokyo (JP); Nakayasu Tsukahara, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 734 days.

(21) Appl. No.: 12/589,516

(22) Filed: Dec. 8, 2008

(65) Prior Publication Data

US 2010/0144421 A1 Jun. 10, 2010

(51) Int. Cl.
*A63F 9/24* (2006.01)

(52) U.S. Cl. ..... 463/20; 463/25; 463/30

(58) Field of Classification Search ..... 463/20, 463/41, 42, 43, 25, 30
See application file for complete search history.

(56) References Cited

U.S. PATENT DOCUMENTS

| | | | | |
|---|---|---|---|---|
| 6,012,983 | A | 1/2000 | Walker et al. | |
| 6,093,102 | A | 7/2000 | Bennett | |
| 6,960,133 | B1 | 11/2005 | Marks et al. | |
| 2004/0147311 | A1 * | 7/2004 | Fujimoto | 463/25 |
| 2008/0227522 | A1 * | 9/2008 | Toyoda | 463/20 |
| 2009/0233677 | A1 * | 9/2009 | Oomori | 463/20 |

* cited by examiner

*Primary Examiner* — Ronald Laneau
*Assistant Examiner* — Wilner Jean Baptiste
(74) *Attorney, Agent, or Firm* — Sheppard, Mullin, Richter & Hampton LLP

(57) ABSTRACT

A slot machine of the present invention is provided with a plurality of BET input devices with each of which a player can bet game media in a different amount. The number of times that a game is played is counted in association with the BET input device with which a BET has been inputted in that game. A predetermined profit is offered based on the number of times counted in association with the BET input device.

9 Claims, 18 Drawing Sheets

FIG. 5

| Symbol | Amount of payout per dollar (dollars) | | | |
|---|---|---|---|---|
| | Number of rearranged symbols | | | |
| | 3 symbols | 4 symbols | 5 symbols | 6 or more symbols |
| RIBBON | 2 | 4 | 6 | m×(n-2) (※) |
| HEART | 3 | 6 | 9 | |
| STAR | 5 | 10 | 15 | |
| MOON | 8 | 16 | 24 | |
| SUN | 10 | 20 | 30 | |
| JEWEL | 15 | 30 | 45 | |
| CROWN | 20 | 40 | 60 | |
| SMILE | 30 | 60 | 90 | |

※ "m" represents the amount of payout when 3 symbols are rearranged.

"n" represents the number of rearranged symbols.

FIG. 10

| BET button | Amount of BET (dollars) | Predetermined number of times (number of games) | Amount of insurance payout (dollars) |
|---|---|---|---|
| 1-dollar BET button | 1 | 2500 | 500 |
| 10-dollar BET button | 10 | 250 | 500 |
| 25-dollar BET button | 25 | 100 | 500 |

FIG. 11

| BET button | Amount of BET (dollars) | Amount of insurance BET (dollars) | Predetermined number of times (number of games) | Amount of insurance payout (dollars) |
|---|---|---|---|---|
| 1-dollar BET button | 1 | 10 | 500 | 100 |
| 10-dollar BET button | 10 | 100 | | 1000 |
| 25-dollar BET button | 25 | 250 | | 2500 |

SLOT MACHINE HAVING A PLURALITY OF INPUT DEVICES AND CONTROL METHOD THEREOF

BACKGROUND OF THE INVENTION

1. Field of the Invention

The present invention relates to a slot machine having a plurality of BET input devices, and a control method thereof.

2. Discussion of the Background

Conventionally, a gaming machine named slot machine has been known. In a slot machine, generally, a game having the following procedure is repeatedly played: a plurality of types of symbols are scroll-displayed and then stop-displayed; and game media is paid out when the stop-displayed symbols form a predetermined winning combination. Such gaming machines are disclosed, for example, in U.S. Pat. No. 6,960,133, U.S. Pat. No. 6,012,993, and U.S. Pat. No. 6,093,102.

The conventional slot machine is generally provided with a BET input device (e.g. a BET button) with which game media (e.g. a medal, a coin, a bill, etc.) can be betted. The player can bet game media in an amount equal to or less than the predetermined upper limit, by operating the BET input device in each game. Generally, the amount of game media to be paid out is determined based on the amount of the betted game media, and the larger amount of the betted game media is set to result in the larger amount of the game media to be paid out. For example, in many slot machines, the number of coins to be paid out based on the winning of a prize in the case of a BET of a single coin (number of payouts per single coin) is determined for each type of the prizes. In this case, the number of betted coins being two may double the number of coins to be paid out, compared to the number in the case where the number of betted coins is one.

However, in the conventional slot machine, the amount of the betted game media is related only to the amount of game media to be paid out in the game in which that BET has been placed. Namely, the amount of the betted game media has no influence on a profit that the player may receive after completion of the game in which that BET has been placed. The player therefore does not consider the advantageous amount of game media to bet in the present game, from a long-term point of view, when placing a BET in each game. In this regard, a determination made by the player in betting is comparatively simple and has no strategy.

Thus, the inventor of the present invention has thought allowing the determination made by the player in betting to have a strategy may result in a further attractive game.

The present invention was made in view of the aforementioned issues, and an object thereof is to provide a slot machine capable of allowing the determination made by the player in betting to have a strategy, and a control method thereof.

SUMMARY OF THE INVENTION

The present invention provides a slot machine having the following configuration.

Namely, the slot machine comprises: a plurality of BET input devices with each of which game media in a different amount can be betted; a symbol display capable of variably displaying a plurality of symbols; and a controller. The controller programmed to execute the processing of: (A) receiving an input of a BET from each of the plurality of BET input devices; (B) variably displaying and then stop-displaying the plurality of symbols to the symbol display after the input of the BET in the processing (A), determining an amount of payout based on the amount of the game media betted in the processing (A) and either the stop-displayed symbol or a combination of the symbols, and paying out game media in an amount corresponding to the determined amount of payout; (C) counting the number of times that the processing (B) has been conducted, in association with the BET input device with which the BET has been inputted in the processing (A); and (D) offering a predetermined profit based on the number of times counted in association with the BET input device in the processing (C).

The above slot machine is provided with the plurality of BET input devices with each of which a player can bet game media in a different amount. Examples of the plurality of BET input devices of this kind may include a 1-dollar BET button with which one dollar worth of game media can be betted, a 10-dollar BET button with which 10 dollars worth of game media can be betted, and a 25-dollar BET button with which 25 dollars worth of game media can be betted.

The number of times that a game is played is counted in association with the BET input device with which a BET has been inputted in that game. A predetermined profit is offered based on the number of times counted in association with the BET input device.

Accordingly, offering of the predetermined profit is related with the following: which BET input device a player has used in betting; and how many times the player has betted by using that BET input device in the past games. This allows the player to place a BET aimed at a predetermined profit which may be offered in the future when placing a BET in each game, so that a determination made by the player in betting is allowed to have a strategy. Further, the player is allowed to consider the advantageous amount of game media to bet in the present game, from a long-term point of view. As a result, it is possible to enhance an attractive aspect of the game and to have the player absorbed in the game.

The slot machine of the present invention preferably has the following configuration.

Namely, the processing (D) includes offering a predetermined profit when the number of times counted in association with any one of the BET input devices has reached a predetermined number of times which has been set for that BET input device, among the numbers of times counted in association with the BET input devices in the processing (C).

According to the slot machine, the predetermined profit is offered when the number of times counted in association with any BET input device has reached the predetermined number of times set for that BET input device. For example, the predetermined profit is offered when the number of times counted in association with the 1-dollar BET button has reached 2500. The predetermined profit is also offered when the number of times counted in association with the 10-dollar BET button has reached 250. Moreover, the predetermined profit is offered when the number of times counted in association with the 25-dollar BET button has reached 100. Namely, the BET input device is associated with the predetermined number of times for defining the timing of when the predetermined profit is offered.

Accordingly, a player who wants to receive the predetermined profit earlier places a BET by using the BET input device corresponding to the smaller predetermined number of times. Further, a player who wants to receive the predetermined profit after playing games for a long time places a BET by using the BET input device corresponding to the larger predetermined number of times. Consequently, the player can receive the predetermined profit at his or her own timing.

As above, the slot machine is capable of allowing the player to think about the timing of when the predetermined profit is offered and to have a longer-term point of view.

The slot machine of the present invention preferably has the following configuration.

Namely, the controller is further programmed to execute the processing of (E) clearing only the number of times counted in association with that BET input device.

According to the slot machine, when the number of times counted in association with any BET input device has reached the predetermined number of times, the predetermined profit is offered and only the number of times counted in association with that BET input device is cleared. Namely, the numbers of times counted in association with the BET input devices other than that BET input device are not cleared. Accordingly, even after the predetermined profit is offered based on the number of times counted in association with one BET input device having reached the predetermined number of times, the predetermined profit may be offered if the number of times counted in association with another BET input device has reached the predetermined number of times. This keeps an expectation of the player for receiving the predetermined profit even after the predetermined profit is once offered.

The present invention further provides a slot machine having the following configuration.

Namely, the slot machine comprises: a plurality of BET input devices with each of which game media in a different amount can be betted; a symbol display capable of variably displaying a plurality of symbols; and a controller. The controller is programmed to execute the processing of: (A) receiving an input of a BET from each of the plurality of BET input devices; (B) variably displaying and then stop-displaying the plurality of symbols to the symbol display after the input of the BET in the processing (A), determining an amount of payout based on the amount of the game media betted in the processing (A) and either the stop-displayed symbol or a combination of the symbols, and paying out game media in an amount corresponding to the determined amount of payout; (C) counting the number of times that the processing (B) has been conducted, in association with the BET input device with which the BET has been inputted in the processing (A); and (D) offering a predetermined profit set for the BET input device, when the number of times counted in association with that BET input device satisfies a predetermined condition, among the numbers of times counted in association with the BET input devices in the processing (C).

The above slot machine is provided with the plurality of BET input devices with each of which a player can bet game media in a different amount. Examples of the plurality of BET input devices of this kind may include a 1-dollar BET button with which one dollar worth of game media can be betted, a 10-dollar BET button with which 10 dollars worth of game media can be betted, and a 25-dollar BET button with which 25 dollars worth of game media can be betted.

The number of times that a game is played is counted in association with the BET input device with which a BET has been inputted in that game. A predetermined profit is offered based on the number of times counted in association with the BET input device.

Accordingly, offering of the predetermined profit is related with the following: which BET input device a player has used in betting; and how many times the player has betted by using that BET input device in the past games. This allows the player to place a BET aimed at a predetermined profit which may be offered in the future when placing a BET in each game, so that a determination made by the player in betting is allowed to have a strategy. Further, the player is allowed to consider the advantageous amount of game media to bet in the present game, from a long-term point of view. As a result, it is possible to enhance an attractive aspect of the game and to have the player absorbed in the game.

According to the slot machine, when the number of times counted in association with any BET input device satisfies the predetermined condition, the predetermined profit corresponding to that BET input device is offered. For example, 10 free games are played when the number of times counted in association with the 1-dollar BET button has satisfied the predetermined condition. Further, 20 free games are played when the number of times counted in association with the 10-dollar BET button satisfies the predetermined condition. Furthermore, 30 free games are played when the number of times counted in association with 25-dollar BET button satisfies the predetermined condition. Namely, the BET input devices are respectively associated with the magnitude of the predetermined profit.

As above, it is possible to allow the player to think about the magnitude of the predetermined profit which may be offered in the future and to have a longer-term point of view.

The slot machine of the present invention preferably has the following configuration.

Namely, the processing (D) includes paying out game media in an amount set for the BET input device, when the number of times counted in association with that BET input device satisfies the predetermined condition, among the numbers of times counted in association with the BET input devices in the processing (C).

According to the slot machine, when the number of times counted in association with any BET input device satisfies the predetermined condition, game media in an amount set for that BET input device are paid out. For example, 100 dollars are paid out when the number of times counted in association with the 1-dollar BET button satisfies the predetermined condition. Further, 1000 dollars are paid out when the number of times counted in association with the 10-dollar BET button satisfies the predetermined condition. Furthermore, 2500 dollars are paid out when the number of times counted in association with the 25-dollar BET button satisfies the predetermined condition. Namely, the BET input devices are respectively associated with the amount of game media to be paid out as the predetermined profit.

On the other hand, according to the slot machine, the game media is paid out in an amount corresponding to the amount of payout determined based on the amount of the betted game media in each game.

As above, which BET input device is used to place a BET in each game is related to both the amount of payout in the present game and the amount of game media to be paid out as the predetermined profit. Accordingly, it is possible to have the player consider how much game media to bet in order to obtain the largest amount of game media. Thus, the player is further absorbed in the game.

The slot machine of the present invention preferably has the following configuration.

Namely, the controller is further programmed to execute the processing of (E) clearing only the number of times counted in association with that BET input device.

According to the slot machine, when the number of times counted in association with any BET input device satisfies the predetermined condition, the predetermined profit is offered and only the number of times counted in association with that BET input device is cleared. Namely, the numbers of times counted in association with the BET input devices other than that BET input device are not cleared. Accordingly, even after the predetermined profit is offered based on the number of times counted in association with one BET input device having reached the predetermined number of times, the predetermined profit may be offered if the number of times counted in association with another BET input device has reached the predetermined number of times. This keeps an expectation of the player for receiving the predetermined profit even after the predetermined profit is once offered.

The present invention further provides a control method of a slot machine, the control method having the following configuration.

Namely, the control method of a slot machine comprises the steps of: (A) receiving an input of a BET from each of a plurality of BET input devices with which game media in a different amount can be betted; (B) variably displaying and then stop-displaying a plurality of symbols to a symbol display after the input of the BET in the step (A), determining an amount of payout based on the amount of the game media betted in the step (A) and either the stop-displayed symbol or a combination of the symbols, and paying out game media in an amount corresponding to the determined amount of payout; (C) counting the number of times that the step (B) has been conducted, in association with the BET input device with which the BET has been inputted in the step (A); and (D) offering a predetermined profit based on the number of times counted in association with the BET input device in the step (C).

The above slot machine is provided with the plurality of BET input devices with each of which a player can bet game media in a different amount. Examples of the plurality of BET input devices of this kind may include a 1-dollar BET button with which one dollar worth of game media can be betted, a 10-dollar BET button with which 10 dollars worth of game media can be betted, and a 25-dollar BET button with which 25 dollars worth of game media can be betted.

According to the control method of the slot machine, the number of times that a game is played is counted in association with the BET input device with which a BET has been inputted in that game. A predetermined profit is offered based on the number of times counted in association with the BET input device.

Accordingly, offering of the predetermined profit is related with the following: which BET input device a player has used in betting; and how many times the player has betted by using that BET input device in the past games. This allows the player to place a BET aimed at a predetermined profit which may be offered in the future when placing a BET in each game, so that a determination made by the player in betting is allowed to have a strategy. Further, the player is allowed to consider the advantageous amount of game media to bet in the present game, from a long-term point of view. As a result, it is possible to enhance an attractive aspect of the game and to have the player absorbed in the game.

Further, the present invention provides a control method of a slot machine, the control method having a following configuration.

Namely, the control method of a slot machine comprises the steps of: (A) receiving an input of a BET from each of a plurality of BET input devices with which game media in a different amount can be betted; (B) variably displaying and then stop-displaying a plurality of symbols to a symbol display after the input of the BET in the step (A), determining an amount of payout based on the amount of the game media betted in the step (A) and either the stop-displayed symbol or a combination of the symbols, and paying out game media in an amount corresponding to the determined amount of payout; (C) counting the number of times that the step (B) has been conducted, in association with the BET input device with which the BET has been inputted in the step (A); and (D) offering a predetermined profit set for the BET input device, when the number of times counted in association with that BET input device has satisfied a predetermined condition, among the numbers of times counted in association with the BET input devices in the step (C).

The above slot machine is provided with the plurality of BET input devices with each of which a player can bet game media in a different amount. Examples of the plurality of BET input devices of this kind may include a 1-dollar BET button with which one dollar worth of game media can be betted, a 10-dollar BET button with which 10 dollars worth of game media can be betted, and a 25-dollar BET button with which 25 dollars worth of game media can be betted.

According to the control method of the slot machine, the number of times that a game is played is counted in association with the BET input device with which a BET has been inputted in that game. A predetermined profit is offered based on the number of times counted in association with the BET input device.

Accordingly, offering of the predetermined profit is related with the following: which BET input device a player has used in betting; and how many times the player has betted by using that BET input device in the past games. This allows the player to place a BET aimed at a predetermined profit which may be offered in the future when placing a BET in each game, so that a determination made by the player in betting is allowed to have a strategy. Further, the player is allowed to consider the advantageous amount of game media to bet in the present game, from a long-term point of view. As a result, it is possible to enhance an attractive aspect of the game and to have the player absorbed in the game.

According to the control method of the slot machine, when the number of times counted in association with any BET input device satisfies the predetermined condition, the predetermined profit corresponding to that BET input device is offered. For example, 10 free games are played when the number of times counted in association with the 1-dollar BET button has satisfied the predetermined condition. Further, 20 free games are played when the number of times counted in association with the 10-dollar BET button satisfies the predetermined condition. Furthermore, 30 free games are played when the number of times counted in association with 25-dollar BET button satisfies the predetermined condition. Namely, the BET input devices are respectively associated with the magnitude of the predetermined profit.

As above, it is possible to allow the player to think about the magnitude of the predetermined profit which may be offered in the future and to have a longer-term point of view.

The present invention further provides a slot machine having the following configuration.

Namely, the slot machine comprises: a BET input device with which game media in an amount corresponding to any amount of BET among a plurality of amounts of BET can be betted; a symbol display capable of variably displaying a plurality of symbols; and a controller. The controller is programmed to execute the processing of (A) receiving an input of a BET from the BET input device; (B) variably displaying and then stop-displaying the plurality of symbols to the symbol display after the input of the BET in the processing (A), determining an amount of payout based on the amount of the game media betted in the processing (A) and either the stop-displayed symbols or a combination of the symbols, and paying out game media in an amount corresponding to the amount of the game media betted in the processing (A); (C) counting a number of times that the processing (B) has been conducted, in association with the amount of BET corresponding to the amount of the game media betted in the processing (A); and (D) offering a predetermined profit based on the number of times counted in association with the amount of BET in the processing (C).

The slot machine is provided with the BET input device with which game media in an amount corresponding to any amount of BET among a plurality of the amounts of BET can be betted. Examples of the plurality of the amounts of BET include one dollar, 10 dollars, and 25 dollars. Examples of the BET input device may include a BET input device with which one dollar worth of game media can be betted by pressing once, 10 dollars worth of game media can be betted by pressing twice, and 25 dollars worth of game media can be betted by pressing for three times.

The number of times that the game has been played is counted in association with the amount of BET corresponding to the amount of game media betted in that game. The predetermined profit is offered based on the number of times counted in association with the amount of BET.

Accordingly, offering of the predetermined profit is related with the following: which amount of BET the amount of the betted game media is corresponding to; and how many times the player has betted the game media in that amount in the past games. This allows the player to place a BET aimed at a predetermined profit which may be offered in the future when placing a BET in each game, so that a determination made by the player in betting is allowed to have a strategy. Further, the player is allowed to consider the advantageous amount of game media to bet in the present game, from a long-term point of view. As a result, it is possible to enhance the attractive aspect of the game and to have the player absorbed in the game.

Further, the present invention provides a control method of a slot machine, the control method having a following configuration.

Namely, the control method of a slot machine comprises the steps of: (A) receiving an input of a BET from a BET input device with which game media in an amount corresponding to any amount of BET among a plurality of amounts of BET can be betted; (B) variably displaying and then stop-displaying a plurality of symbols to a symbol display after the input of the BET in the step (A), determining an amount of payout based on the amount of the game media betted in the step (A) and either the stop-displayed symbols or a combination of the symbols, and paying out game media in an amount corresponding to the determined amount of payout; (C) counting the number of times that the step (B) has been conducted, in association with the amount of BET corresponding to the amount of the game media betted in the step (A); and (D) offering a predetermined profit based on the number of times counted in association with the amount of BET in the step (C).

The slot machine is provided with the BET input device with which game media in an amount corresponding to any amount of BET among a plurality of the amounts of BET can be betted. Examples of the plurality of the amounts of BET include one dollar, 10 dollars, and 25 dollars. Examples of the BET input device may include a BET input device with which one dollar worth of game media can be betted by pressing once, 10 dollars worth of game media can be betted by pressing twice, and 25 dollars worth of game media can be betted by pressing for three times.

According to the control method of the slot machine, the number of times that the game has been played is counted in association with the amount of BET corresponding to the amount of game media betted in that game. The predetermined profit is offered based on the number of times counted in association with the amount of BET.

Accordingly, offering of the predetermined profit is related with the following: which amount of BET the amount of the betted game media is corresponding to; and how many times the player has betted the game media in that amount in the past games. This allows the player to place a BET aimed at a predetermined profit which may be offered in the future when placing a BET in each game, so that a determination made by the player in betting is allowed to have a strategy. Further, the player is allowed to consider the advantageous amount of game media to bet in the present game, from a long-term point of view. As a result, it is possible to enhance the attractive aspect of the game and to have the player absorbed in the game.

BRIEF DESCRIPTIONS OF THE DRAWINGS

FIG. 5 is a view illustrating a corresponding relationship between rearranged symbols and amounts of payouts per dollar.

FIG. 10 is a view illustrating an insurance table according to another embodiment.

FIG. 11 is a view illustrating an insurance table according to a second embodiment.

DESCRIPTION OF THE EMBODIMENTS

First Embodiment

The outline of a first embodiment is described with reference to FIGS. 1A and 1B.

Figure 1A:
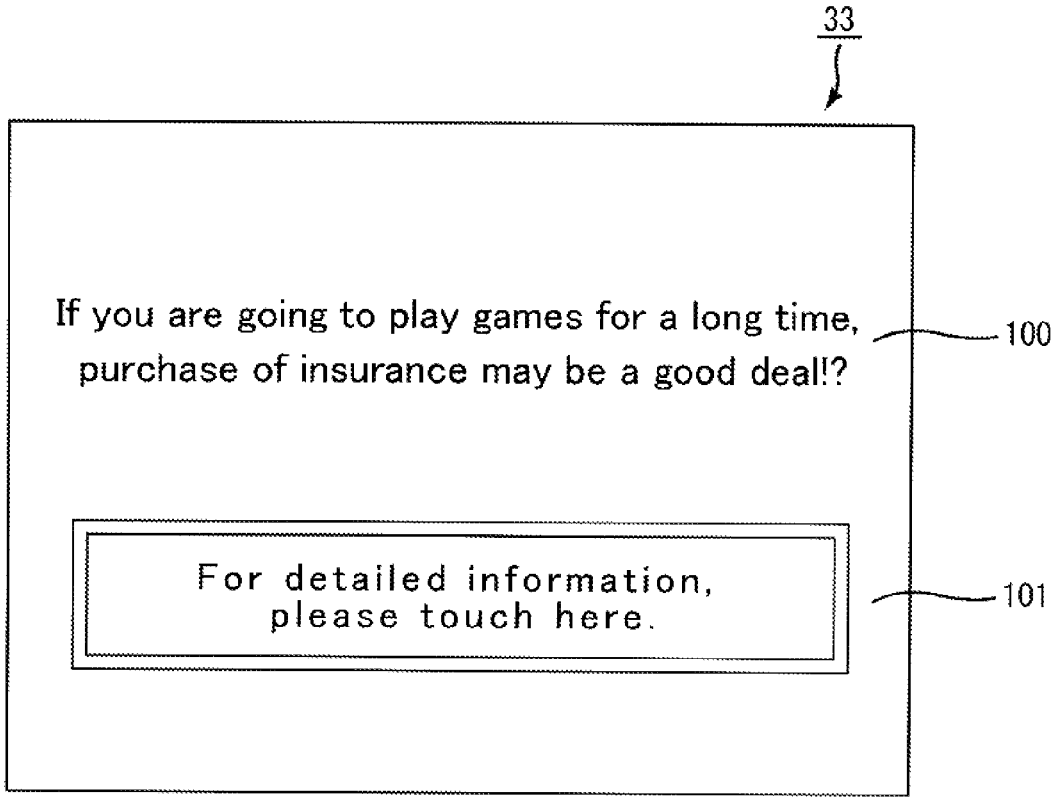
FIG. 1A is a view illustrating an exemplary image to be displayed to an upper image display panel.
Figure 1B:
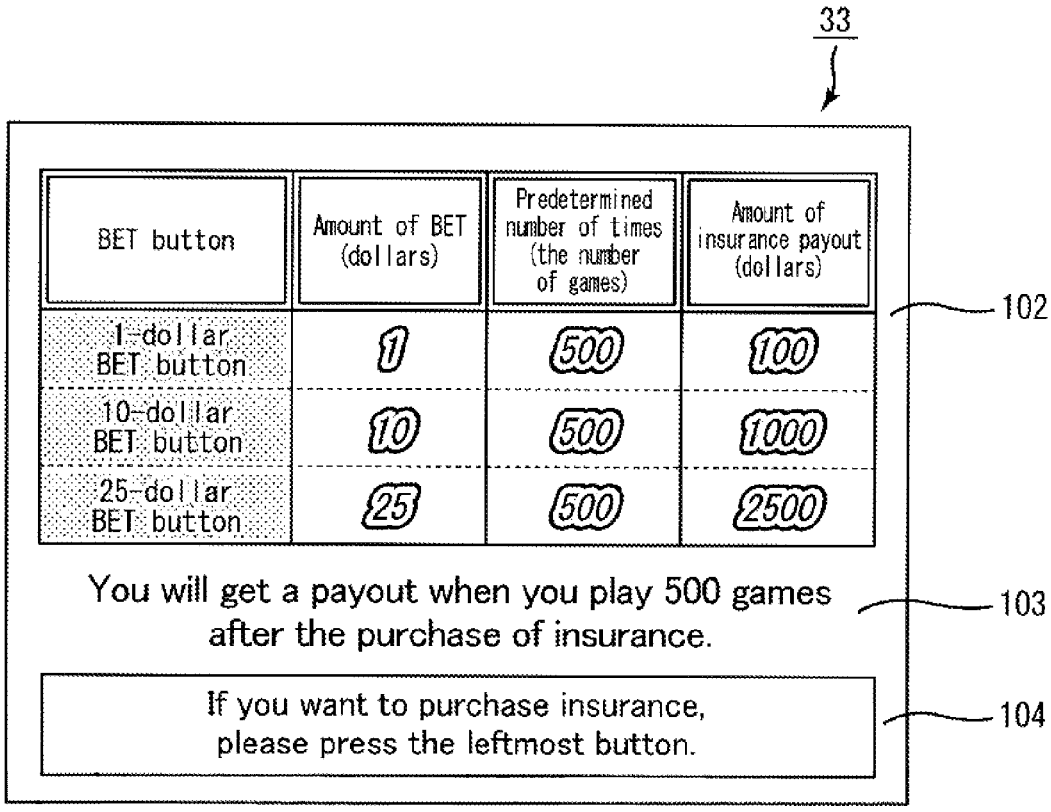
FIG. 1B is another view illustrating an exemplary image to be displayed to an upper image display panel.

FIGS. 1A and 1B are views each illustrating an exemplary image to be displayed to an upper image display panel.

FIG. 1A shows a state that a non-insurance mode image is displayed to an upper image display panel 33 (see FIG. 2) provided in a slot machine 10 according to the first embodiment. The non-insurance mode image includes a text image 100 and a screen switch image 101.

The text image 100 is for encouraging a player who is going to play games for a long time to purchase the insurance. In the present description, pressing an insurance BET button 90 (see FIG. 2) is also referred to as "purchasing the insurance".

The screen switch image 101 indicates that an image of detailed information of the insurance (an insurance information image) can be displayed. A player can switch the displayed image from the non-insurance mode image shown in FIG. 1A to the insurance information image shown in FIG. 13, by touching a part corresponding to the screen switch image 101 on a touch panel (not shown) provided on the upper image display panel 33.

The insurance information image shown in FIG. 1B includes an insurance table image 102 and a text image 103 and a text image 104.

The insurance table image 102 illustrates an insurance table. In the insurance table, the type of BET buttons, the amount of BET, and the amount of insurance payout are associated with one another. The slot machine 10 according to the first embodiment is provided with three types of BET buttons. The three types of BET buttons include a 1-dollar BET button 26, a 10-dollar BET button 27, and a 25-dollar BET button 28 (see FIG. 2).

Each of the BET buttons is for placing a BET of the amount of BET associated with that BET button in the insurance table. The player can bet one dollar by pressing the 1-dollar BET button 26. The player can bet 10 dollars by pressing the 10-dollar BET button 27. The player can bet 25 dollars by pressing the 25-dollar BET button 28.

The 1-dollar BET button 26, the 10-dollar BET button 27, and the 25-dollar BET button 28 constitute the plurality of BET input devices of the present invention.

In the insurance table, 500 times is associated with each BET button as the predetermined numbers of times. According to the slot machine 10 of the first embodiment, the number of times of the games played after the purchase of the insurance is counted in association with the BET button with which the BET has been inputted in that game. For example, when the game is played in which the 1-dollar BET button 26 has been pressed, 1 is added to the number of times counted in association with the 1-dollar BET button 26.

When the number of times counted in association with any BET button has reached 500 times, coins are paid out, which is shown in the text image 103.

The amount to be paid out is the amount of insurance payout associated with each BET button. For example, when the number of times counted in association with the 25-dollar BET button 28 has reached 500 times, 2500 dollars are paid out.

The text image 104 shows that it is possible to purchase the insurance by pressing the insurance BET button 90 and that the location of the insurance BET button 90.

There has been described the outline of the first embodiment.

Hereinafter, the first embodiment will be described in more detail.

Figure 2:
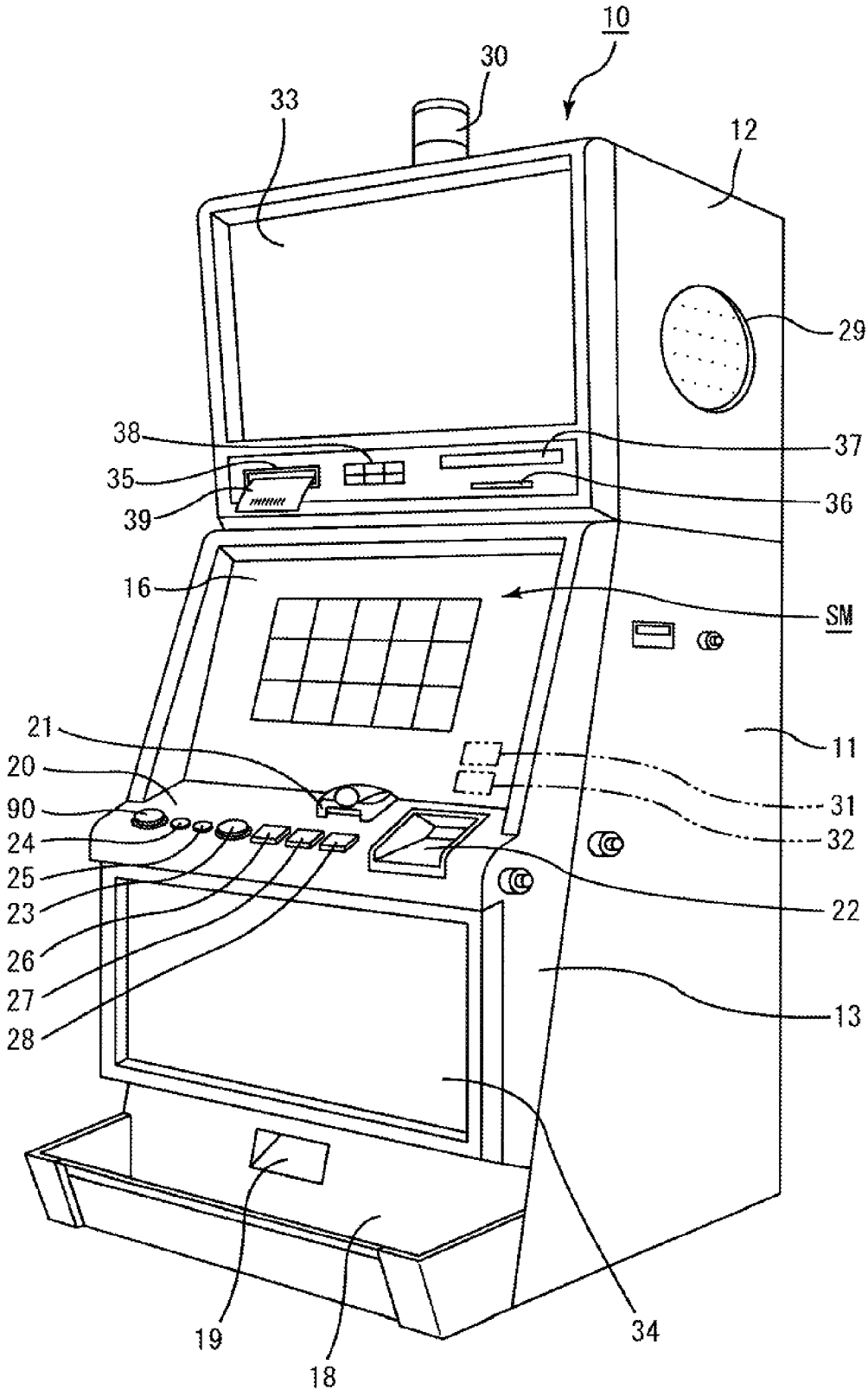
FIG. 2 is a perspective view illustrating the external appearance of a slot machine.

FIG. 2 is a perspective view illustrating the external appearance of the slot machine.

In the slot machine 10, a coin, a bill, or electronic valuable information corresponding thereto is used as a game medium. However, in the present invention, a game medium is not particularly limited. Examples of the game medium may include a medal, a token, electronic money, or a ticket. It should be noted that the ticket is not particularly limited, and examples thereof include a ticket with a barcode, which will be described later.

Here, the slot machine 10 is a stand-alone type slot machine that is not connected to a network, but the present invention can also be applied to a slot machine connected to a network.

The slot machine 10 includes: a cabinet 11; a top box 12 placed on the upper side of the cabinet 11; and a main door 13 provided at the front face of the cabinet 11. The lower image display panel 16 is provided in front of the main door 13. The lower image display panel 16 includes a liquid crystal display panel and the symbol matrix SM is displayed thereto. In the lower image display panel 16, there are provided an amount-of-credit display section 31 and an amount of payout display section 32 (not shown).

The amount-of-credit display section 31 displays an image indicating the credited amount. The amount-of-payout display section 32 displays an image indicating the amount to be paid out as the payout.

In the present embodiment, a case where symbols are rearranged in the symbol matrix SM in the lower image display panel 16 (i.e. a case where the slot machine 10 is a so-called video slot machine). However, the slot machine of the present invention may be configured to stop-display the symbols by using a so-called mechanical reels. The lower image display panel 16 corresponds to the symbol display of the present invention.

Further, a touch panel 69, which is not shown in the figure, is provided on the front face of the lower image display panel 16, and the player can input various kinds of commands by operating the touch panel 69.

Below the lower image display panel 16, there are provided a control panel 20 comprised of a plurality of buttons 23 to 28 and 90 with each of which a command according to the game progress is inputted by the player, a coin receiving slot 21 through which a coin is accepted into the cabinet 11, and a bill validator 22.

The control panel 20 is provided with a start button 23, a change button 24, a CASHOUT button 25, the 1-dollar BET button 26, the 10-dollar BET button 27, the 25-dollar BET button, and the insurance BET button 90. The start button 23 is used for inputting a command to start a game. The change button 24 is used for making a request of staff at a recreation facility for exchange. The CASHOUT button 25 is used for inputting a command to pay out coins corresponding to the credited amount to a coin tray 18.

The 1-dollar BET button 26 is used for inputting a command to bet one dollar on a game out of the credited amount. The 10-dollar BET button is used for inputting a command to bet 10 dollars on a game out of the credited amount. The 25-dollar BET button is used for inputting a command to bet 25 dollars on a game out of the credited amount. The insurance BET button is used for inputting a command to purchase the insurance.

It is to be noted that the BET input devices of the present invention is not limited to buttons. Examples of the plurality of BET input devices may include a plurality of currency insertion slots each capable of receiving currencies such as coins and bills, and a gaming machine may be configured so that a player can place a BET of a different amount on a game by inserting currencies to each currency insertion slot. For example, the following gaming machine may be used: the gaming machine is provided with a 1-dollar-bill insertion slot capable of receiving a 1-dollar bill, a 10-dollar-bill insertion slot capable of receiving a 10-dollar bill, and a 25-dollar-bill insertion slot capable of receiving a 25-dollar bill; and a game is played regarding the amount corresponding to the bill inserted into any bill insertion slot as the amount of BET.

Further, the BET input device of the present invention may be a touch panel. For example, the following gaming machine may be used: a plurality of button images corresponding to a plurality of BET buttons are displayed to a display; and a player can press a part corresponding to each button image on the touch panel to bet game media in an amount corresponding to that button. In this case, a plurality of parts on the touch panel corresponding to respective button images constitute the plurality of BET input devices of the present invention.

The bill validator 22 not only discriminates a regular bill from a false bill, but also accepts the regular bill into the cabinet 11. It should be noted that the bill validator 22 may be configured so as to be capable of reading a later-described ticket 39 with a barcode. At the lower front face of the main door 13, namely below the control panel 20, there is provided a belly glass 34 on which a character or the like of the slot machine 10 is drawn.

At the front face of the top box 12, an upper image display panel 33 is provided. The upper image display panel 33 is provided with a liquid crystal panel to display, for example, an image representing an introduction of the contents of a game or a description of a rule of the game. Especially, in the first embodiment, the non-insurance mode image (see FIG. 1A), the insurance information image (see FIG. 1B), a winning image (see FIG. 9A), and an insurance mode image (see FIG. 9B) are displayed. Although not shown, a touch panel 69 is provided on the front face of the upper image display panel 33, and a player can switch the image to be displayed from the non-insurance mode image to the insurance information image by operating the touch panel 69.

Further, the top box 12 is provided with a speaker 29. Below the upper image display panel 33, there are provided a ticket printer 35, a card reader 36, a data display 37, and a keypad 38. The ticket printer 35 prints on a ticket a barcode as coded data of the amount of credit, date and time, an identification number of the slot machine 10, and the like, and outputs the ticket as a ticket 39 with a barcode. The player can make another slot machine read the ticket 39 with a barcode to play a game thereon, or can exchange the ticket 39 with a barcode with bills or the like at a predetermined place in the recreation facility (for example, a cashier in a casino).

The card reader 36 reads data from a smart card and writes data into the smart card. The smart card is a card owned by the player, and for example, data for identifying a player and data on a history of games played by the player are stored therein. Data corresponding to a coin, a bill, or a credit may be stored in the smart card. Further, in place of the smart card, a magnetic stripe card may be adopted. The data display 37 is comprised of a fluorescent display or the like, and displays, for example, data read by the card reader 36 or data inputted by the player through the keypad 38. The keypad 38 is used for inputting a command and data concerning the issue of a ticket and the like.

Figure 3:
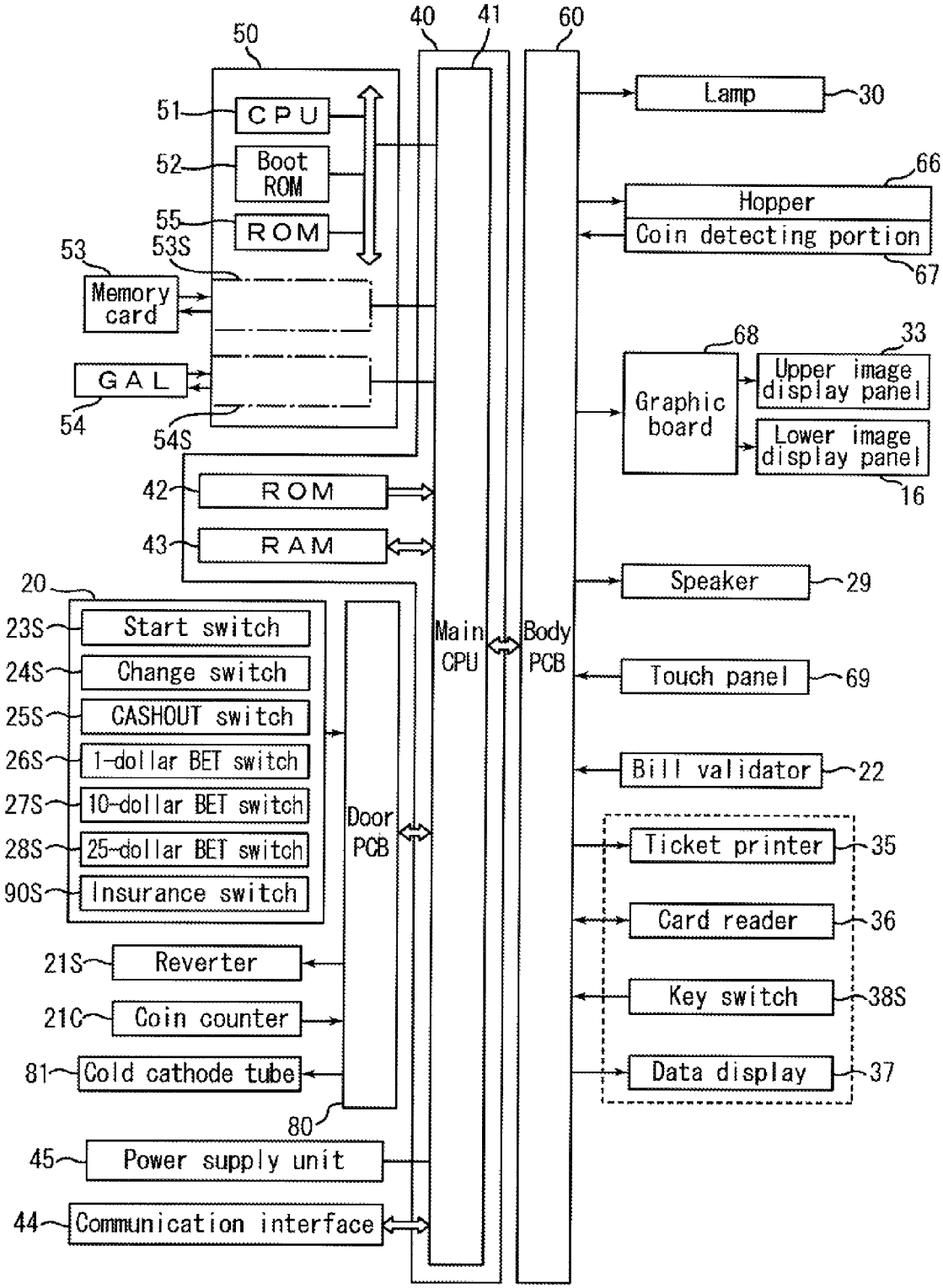
FIG. 3 is a block diagram illustrating an internal configuration of the slot machine illustrated in FIG. 2.

FIG. 3 is a block diagram showing an internal configuration of the slot machine shown in FIG. 2.

A gaming board 50 includes a CPU (Central Processing Unit) 51, a ROM 55, and a boot ROM 52 which are interconnected to one another via an internal bus, a card slot 53S corresponding to a memory card 53, and an IC socket 54S corresponding to a GAL (Generic Array Logic) 54.

The memory card 53 is formed from a nonvolatile memory such as CompactFlash (registered trademark) and stores game programs and game system programs. The game programs include a symbol selection program. The aforementioned symbol selection program is a program for determining the symbols to be rearranged in the symbol matrix SM. The aforementioned symbol selection program includes symbol weighing data in association with a plurality of types of payout ratios (for example, 80%, 84%, 88%). The symbol weighing data is data indicating the correspondence between the respective symbols, and one or more random numbers which fall in a predetermined numerical range (0 to 255). The payout ratios are determined based on payout-ratio setting data outputted from the GAL 54 and, based on the symbol weighing data associated with the payout ratios, the symbols to be rearranged in the symbol matrix are determined.

Here, as the symbol to be rearranged in the symbol matrix SM, there are eight types of the symbols including "RIBBON", "HEART", "STAR", "MOON", "SUN", "JEWEL", "CROWN" and "SMILE". Further, all the symbols are constituted by so-called scatter symbols.

Further, the game program includes odds data (See FIG. 5) indicating the amount of payout per dollar (odds). The odds indicate a relationship between a type of a prize and an amount to be paid out when the prize is won.

Further, the card slot 53S is configured so as to allow the memory card 53 to be inserted thereinto or ejected therefrom, and is connected to a mother board 40 via an IDE bus. Thus, the memory card 53 can be ejected from the card slot 53S, and then another game program is written onto the memory card 53, and the memory card 53 can be inserted into the card slot 53S, to change the type and contents of a game to be played on the slot machine 10. The game program includes a program associated with the progress of a game. The game program also includes image data and sound data to be outputted during the game. The image data includes image data indicating a symbol matrix, the non-insurance mode image, the insurance information image, the winning image, and the insurance mode image.

The GAL 54 is a type of PLD having a fixed OR array structure. The GAL 54 includes a plurality of input ports and a plurality of output ports and, when predetermined data is inputted to an input port, the GAL 54 outputs data corresponding to the aforementioned data from an output port. The data outputted from this output port is the aforementioned payout-ratio setting data.

Further, the IC socket 54S is configured to allow the GAL 54 to be attached thereto and detached therefrom and is connected to the mother board 40 through a PCI bus. Accordingly, the GAL 54 can be replaced with another GAL 54 to change the payout-ratio setting data.

The CPU 51, the ROM 55 and the boot ROM 52 interconnected to one another via an internal bus are connected to the mother board 40 by a PCI bus. The PCI bus supplies power to the gaming board 50 from the mother board 40, as well as transmitting a signal between the mother board 40 and the gaming board 50. The ROM 55 stores country identification information and an authentication program. The boot ROM 52 stores an auxiliary authentication program and a program (boot code) to be used by the CPU 51 for activating the auxiliary authentication program, and the like.

The authentication program is a program (falsification check program) for authenticating a game program and a game system program. The authentication program is written along a procedure (authentication procedure) for checking and proving that a game program and a game system program to be subject to authentication loading processing have not been falsified, namely authenticating the game program and the game system program. The auxiliary authentication program is a program for authenticating the above-mentioned authentication program. The auxiliary authentication program is written along a procedure (authentication procedure) for proving that an authentication program to be subject to the authentication processing has not been falsified, namely, authenticating the authentication program.

The mother board 40 is constructed with a general-purpose mother board commercially available (a printed circuit board on which basic parts of a personal computer are mounted) and includes a main CPU 41, a ROM (Read Only Memory) 42 and a RAM (Random Access Memory) 43. The mother board 40 is the controller of the present invention.

The ROM 42 is constituted of a memory device such as a flash memory and stores thereon a program such as BIOS (Basic Input/Output System) executed by the main CPU 41 and permanent data. When BIOS is executed by the main CPU 41, not only is initialization processing for predetermined peripheral devices conducted, but a capture processing for the game program and game system program stored on the memory card 53 is also started via the gaming board 50. In the present invention, contents of the ROM 42 may be rewritable or not rewritable.

The RAM 43 stores data and a program used at the time of operation of the main CPU 41, and various flags. The RAM 43 can also store the authentication program read through the gaming board 50, the game program, and the game system program. The RAM 43 further stores data on the amount of credit, the amount of BET and the amount of payout for one game, and the like.

The RAM 43 is further provided with a number-of-BETs storage area. The number-of-BETs storage area stores data on a number $C_A$ of 1-dollar BETs, data on a number $C_B$ of 10-dollar BETs, and data on a number $C_C$ of 25-dollar BETs. The number $C_A$ of 1-dollar BETS is the number of times counted in association with the 1-dollar BET button 26. The number $C_B$ of 10-dollar BETs is the number of times counted in association with the 10-dollar BET button 27. The number $C_C$ of 25-dollar BETs is the number of times counted in association with the 25-dollar BET button 28.

The RAM 43 is further provided with a storage area of an insurance flag. The insurance flag is set when the insurance BET button 90 is pressed. The storage area of the insurance flag includes, for example, a storage area of a predetermined number of bits and the insurance flag is turned "ON" or "OFF" in accordance with the storage content in the storage area.

To the mother board 40, a body PCB (Printed Circuit Board) 60 and a door PCB 80, which will be described later, are connected through respective USBs. Further, the mother board 40 is connected with a power supply unit 45. When the power is supplied from the power unit 45 to the mother board 40, the main CPU 41 of the mother board 40 is activated and the power is supplied to the gaming board 50 through the PCI bus so that the CPU 51 is activated.

The body PCB 60 and the door PCB 80 are connected with equipment and devices that generate input signals to be inputted to the main CPU 41, and equipment and devices operations of which are controlled by control signals outputted from the main CPU 41. The main CPU 41 executes a game program stored in the RAM 43 based on an input signal inputted to the main CPU 41, thereby executes the predetermined arithmetic processing and stores a result thereof in the RAM 43, or transmits a control signal to each of the equipment and devices as processing for controlling each of the equipment and devices.

To the body PCB 60, there are connected a lamp 30, a hopper 66, a coin detecting portion 67, a graphic board 68, a speaker 29, a touch panel 69, a bill validator 22, a ticket printer 35, a card reader 36, a key switch 38S, and a data display 37. The lamp 30 lights up in a predetermined pattern based on a control signal outputted from the main CPU 41.

The hopper 66 is installed inside the cabinet 11 and pays out coins from the coin payout exit 19 to the coin tray 18, based on a control signal outputted from the main CPU 41. The coin detecting portion 67 is provided inside the coin payout exit 19, and outputs an input signal to the main CPU 41 when detecting a payout of coins from the coin payout exit 19.

The graphic board 68 controls, based on a control signal outputted from the main CPU 41, an image display to the upper image display panel 33 and the lower image display panel 16. The amount of credit stored in the RAM 43 is displayed to the amount-of-credit display section 31 (not shown) of the lower image display panel 16. The amount of coin-outs is displayed to the amount-of-payout display section 32 (not shown) of the lower image display panel 16. The graphic board 68 is equipped with VDP (Video Display Processor) which generates image data based on a control signal outputted from the main CPU 41 and a video RAM which temporarily stores image data generated by VDP, and of the like equipments. It should be noted that image data used in generating image data with VDP is contained in a game program read from the memory card 53 and stored in the RAM 43.

The bill validator 22 not only discriminates a regular bill from a false bill, but also accepts the regular bill into the cabinet 11. When accepting a regular bill, the bill validator 22 outputs an input signal to the main CPU 41, based on the face amount of the bill. The main CPU 41 stores, in the RAM 43, the amount of credit according to the face amount of the bill transmitted with the input signal.

The ticket printer 35 prints on a ticket, based on a control signal outputted from the main CPU 41, a barcode formed by encoding data such as the amount of credit, date and time, an identification number of the slot machine 10, and of the like data stored in the RAM 43, and outputs the ticket as a ticket 39 with a barcode.

The card reader 36 reads data from a smart card and transmits the data to the main CPU 41 or writes data into the smart card based on a control signal from the main CPU 41. The key switch 38S is provided on the keypad 38, and outputs a predetermined input signal to the main CPU 41 when the keypad 38 is operated by the player. The data display 37 displays, based on a control signal outputted from the main CPU 41, data read by the card reader 36 or data inputted by the player through the keypad 38.

To the door PCB 80, there are connected a control panel 20, a reverter 21S, a coin counter 21C, and a cold cathode tube 81. The control panel 20 is provided with a start switch 23S corresponding to the start button 23, a change switch 24S corresponding to the change button 24, a CASHOUT switch 25S corresponding to the CASHOUT button 25, a 1-dollar BET switch 26S corresponding to the 1-dollar BET button 26, a 10-dollar BET switch 27S corresponding to the 10-dollar BET button 27, a 25-dollar BET switch 28S corresponding to the 25-dollar BET button 28 and an insurance BET switch 90S corresponding to the insurance BET button 90. Each of the switches 23S to 28S and 90S outputs an input signal to the main CPU 41 when each of the buttons 23 to 28 and 90 corresponding thereto is operated by the player.

The coin counter 21C is provided inside the coin receiving slot 21 and discriminates a regular coin from a false coin inserted into the coin receiving slot 21 by the player. Coins other than regular coins are discharged from the coin payout exit 19. When the coin counter 21C detects a regular coin, the coin counter 21C outputs an input signal to the main CPU 41. On receiving the signal outputted from the coin counter 21C, the main CPU 41 conducts processing of making an addition to the amount of credit stored in the RAM 43 as interrupt processing.

The reverter 21S operates based on a control signal outputted from the main CPU 41, and distributes a coin identified by the coin counter 21C as a regular coin into a cash box (not shown) or the hopper 66, which are disposed in the slot machine 10. Specifically, when the hopper 66 is filled with coins, a regular coin is distributed into the cash box by the reverter 21S. On the other hand, when the hopper 66 is not filled with coins, the regular coin is distributed into the hopper 66. The cold cathode tube 81 functions as a backlight installed on the rear face side of the lower image display panel 16 and the upper image display panel 33, and lights up based on a control signal to be outputted from the main CPU 41.

Next, slot machine game execution processing conducted in the slot machine 10 is described with reference to FIGS. 4 to 9.

The main CPU 41 reads and executes a game program, so that the slot machine game proceeds.

Figure 4:
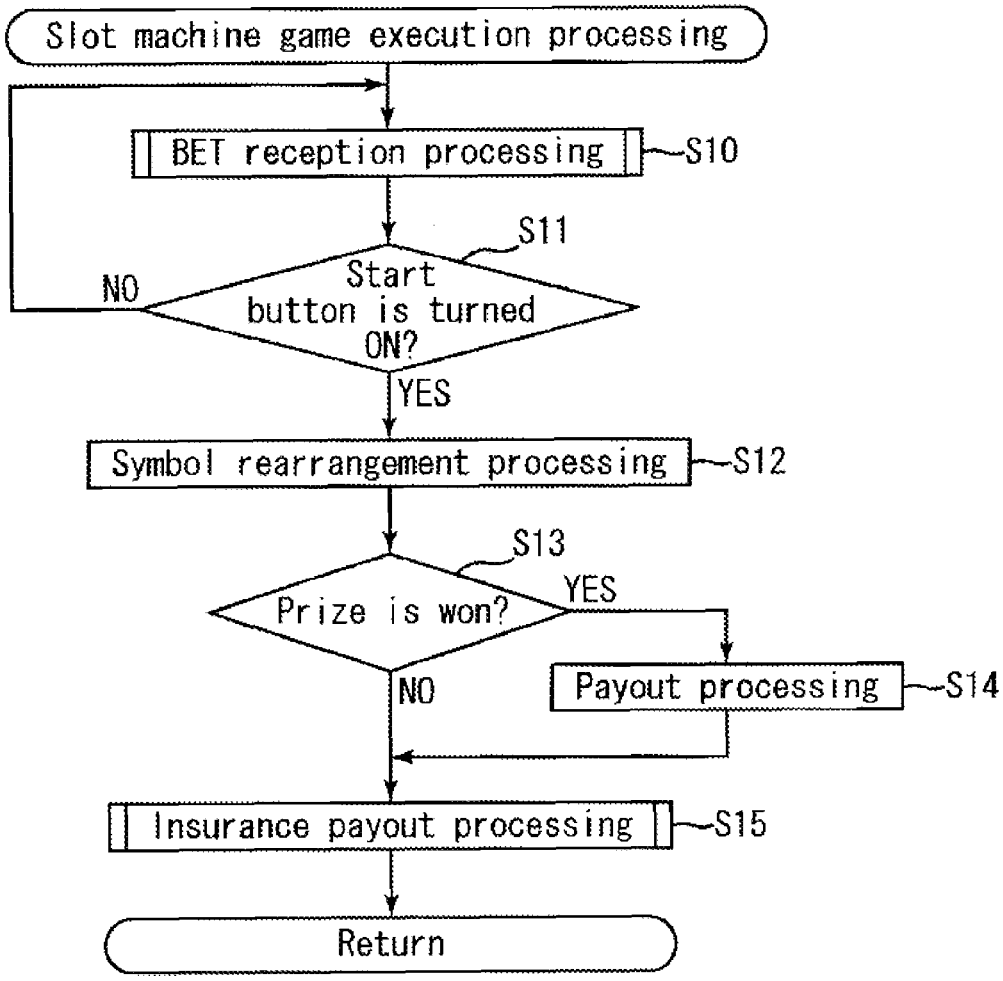
FIG. 4 is a flowchart illustrating a subroutine of slot machine game execution processing according to the first embodiment.

FIG. 4 is a flowchart illustrating a subroutine of slot machine game execution processing according to the first embodiment.

FIG. 5 is a view illustrating a corresponding relationship between rearranged symbols and amounts of payouts per dollar.

First, the main CPU 41 executes BET reception processing (step S10). The BET reception processing is later described in detail with reference to FIGS. 6 and 7.

Next, the main CPU 41 determines whether or not the start button 23 has been turned ON (step S11). In the processing, the main CPU 41 determines whether or not the main CPU 41 has received an input signal outputted from the start switch 23S when the start button 23 is pressed.

When the main CPU 41 determines that the start button 23 has not been turned ON, the main CPU 41 returns the processing to step S10. It should be noted that, when the start button 23 is not turned ON (for example, when a command to end the game is inputted without pressing the start button 23), the main CPU 41 cancels a result of the subtraction of the amount of credit (see steps S21, S25, and S29 in FIG. 6).

On the other hand, when the main CPU 41 determines in step S11 that the start button 23 has been turned ON, the main CPU 41 conducts symbol rearrangement processing (step S12).

In the processing, at first, the main CPU 41 starts scroll-display of the symbols in the symbol matrix SM. Then, the main CPU 41 executes the above-mentioned symbol selection program, determines symbols to be rearranged, and rearranges the symbols in the symbol matrix SM.

Next, the main CPU 41 determines whether or not a prize is won (step S13). Here, winning the prize refers to the rearrangement of at least one combination of three or more symbols of the same type, out of "RIBBON", "HEART", "STAR", "MOON", "SUN", "JEWEL", "CROWN", and "SMILE", in the symbol matrix SM (see FIG. 5). In the processing, the main CPU 41 counts the number of the symbol for each type, with regard to the rearranged symbols in step S12. Then, the main CPU 41 determines whether or not the counted number is equal to or more than three.

When the main CPU 41 determines that the prize has been won, the main CPU 41 conducts processing according to payout of the coin (step S14). In the processing, the main CPU 41 determines the amount of payout based on the number of rearranged symbols with reference to the normal odds data (see FIG. 5) stored in the RAM 43.

For example, in the case of a BET of one dollar and rearrangement of three "SUN", the amount of payout is 10 dollars. In the case of a BET of 10 dollars and rearrangement of five "STAR", the amount of payout is 150 (=15×10) dollars. In the case of a BET of 25 dollars and rearrangement of three "SUN" and five "STAR", the amount of payout is 625 ((10+15)×25) dollars.

In the case of accumulating the coin, the main CPU 41 conducts processing for adding an amount of credit corresponding to the determined amount of payout. On the other hand, in the case of paying out coins, the main CPU 41 transmits a control signal to the hopper 66 in order to pay out the coin in amount corresponding to the determined amount of payout.

When the main CPU 41 determines that the prize has not been won in step S13 or after the processing of step S14, the main CPU 41 executes insurance payout processing (step S15) The insurance payout processing is described later in detail with reference to FIG. 8.

After the processing of step S15, the main CPU 41 completes the present subroutine.

Subsequently, BET reception processing conducted in step S10 is described.

Figure 6:
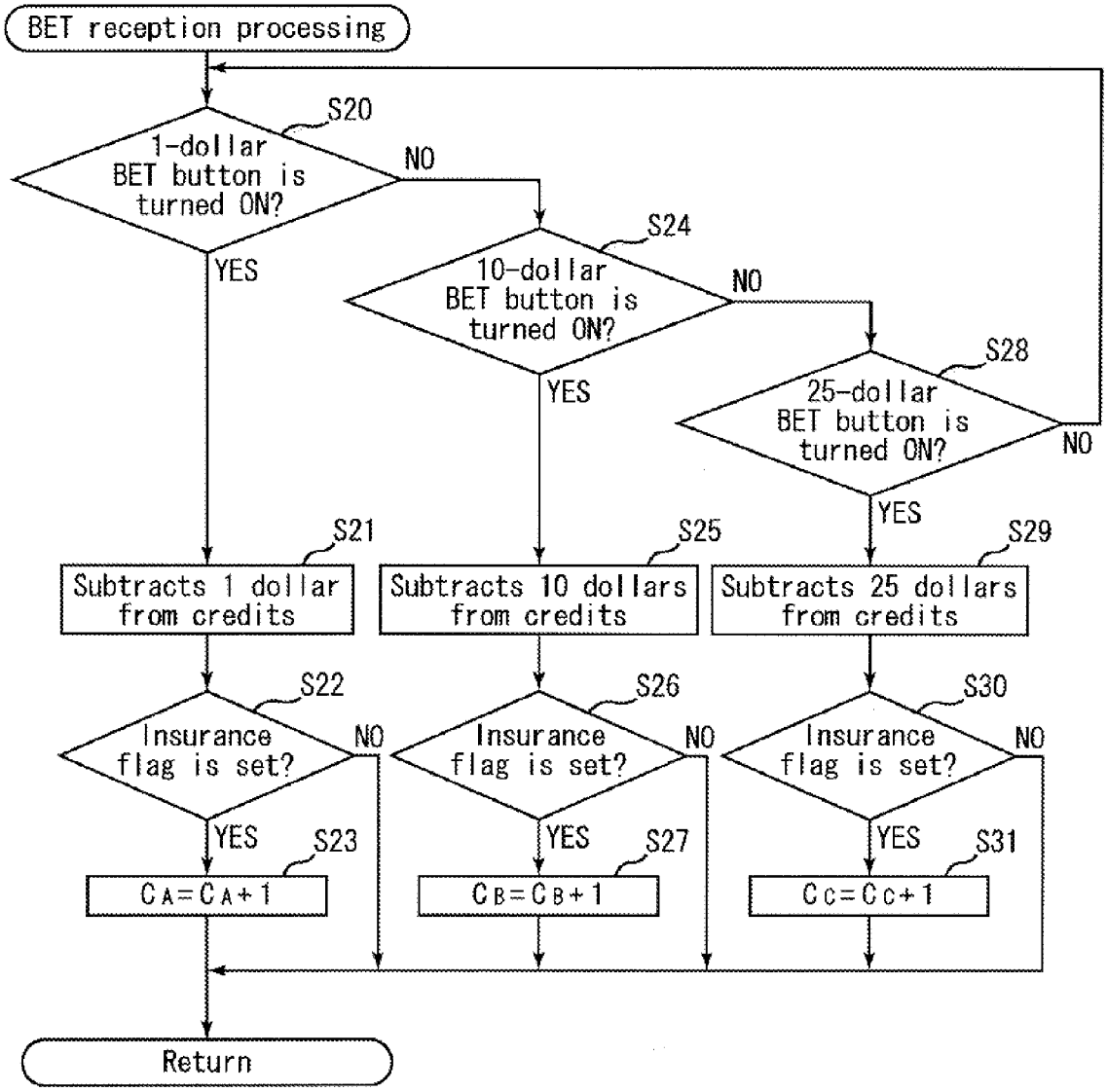
FIG. 6 is a flowchart illustrating a subroutine of BET reception processing according to a first embodiment.

FIG. 6 is a flowchart illustrating a subroutine of BET reception processing according to the first embodiment.

First, the main CPU 41 determines whether or not 1-dollar BET button 26 has been turned ON (step S20). In this processing, the main CPU 41 determines whether or not the main CPU 41 has received an input signal outputted from the 1-dollar BET switch 26S when the 1-dollar BET button 26 is pressed.

When the main CPU 41 determines that the 1-dollar BET button 26 has been turned ON, the main CPU 41 conducts processing of subtracting one dollar from the amount of credit stored in the RAM 43 (step S21). In the case where the betted amount is larger than the amount of credit stored in the RAM 43, the main CPU 41 returns the processing to step S10 without making a subtraction from the amount of credit stored in the RAM 43.

Next, the main CPU 41 determines whether or not the insurance flag is set (step S22). The insurance flag is set when the insurance BET button 90 has been pressed (see step S44 in FIG. 7).

Here, the insurance flag is described with reference to FIG. 7.

Figure 7:
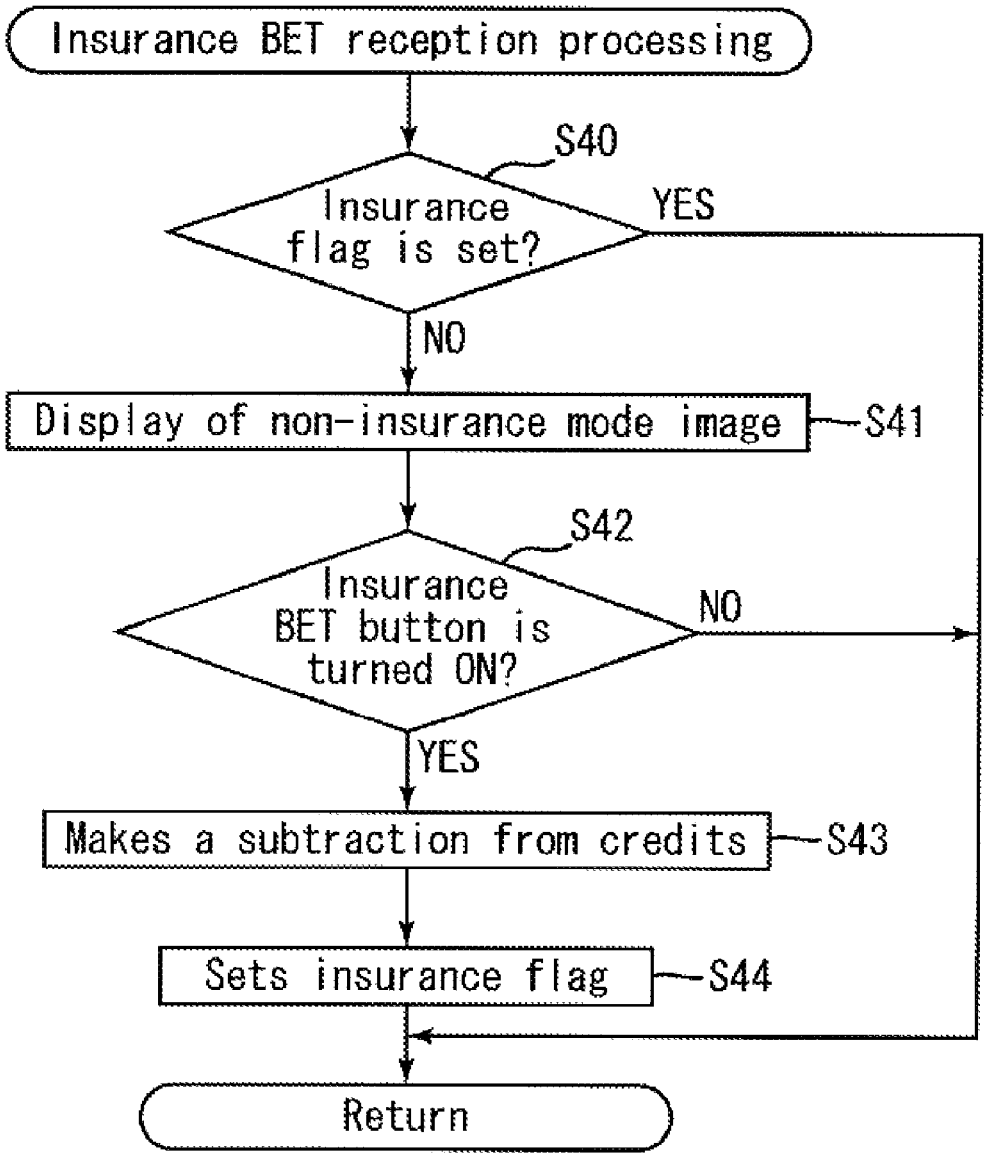
FIG. 7 is a flowchart illustrating a subroutine of insurance BET reception processing according to the first embodiment.

FIG. 7 is a flowchart illustrating a subroutine of insurance BET reception processing according to the first embodiment.

First, the main CPU 41 determines whether or not the insurance flag is set at a predetermined timing (step S40).

When the main CPU 41 determines that the insurance flag is set, the main CPU 41 completes the present subroutine.

On the other hand, when the main CPU 41 determines that the insurance flag is not set, the main CPU 41 displays the non-insurance mode image (see FIG. 1A) to the upper image display panel 33 (step S41). In the case of receiving the screen switch signal while the non-insurance mode image is displayed, the main CPU 41 completes the display of the non-insurance mode image and displays the insurance information image (see FIG. 1B) to the upper image display panel 33. The screen switch signal is outputted from the touch panel 69 when the player has touched the part corresponding to the screen switch image 101 on the touch panel 69 provided on the upper image display panel 33.

Subsequently, the main CPU 41 determines whether or not the insurance BET button 90 has been turned ON (step s42). In this processing, the main CPU 41 determines whether or not the main CPU 41 has received an input signal outputted from the insurance BET switch 90S when the insurance BET button 90 is pressed.

When the main CPU 41 determines that the insurance BET button 90 has not been turned ON, the main CPU 41 completes the present subroutine.

On the other hand, when the main CPU 41 determines that the insurance BET button 90 has been turned ON, the main CPU 41 subtracts a predetermined amount (10 dollars in the first embodiment) from the amount of credit stored in the RAM 43 (step S43).

The main CPU 41 then sets the insurance flag (step S44) and completes the present subroutine.

when the predetermined amount is larger than the amount of credit stored in the RAM 43, the main CPU 41 completes the present subroutine without executing the processing of steps S43 and S44.

As above, the insurance flag is described with reference to FIG. 7.

The description is returned to FIG. 6.

When the main CPU 41 determines that the insurance flag is set in step S22, the main CPU 41 sets the number $C_A$ of 1-dollar BETs to $C_A$=$C_A$+1 (step S23).

When the main CPU 41 determines that the insurance flag is not set in step S22 or after the processing of step S23, the main CPU 41 completes the present subroutine.

When the main CPU 41 determines that the 1-dollar BET button 26 has not been turned ON in step s20, the main CPU 41 determines whether or not the 10-dollar BET button 27 has been turned ON (step S24). In this processing, the main CPU 41 determines whether or not the main CPU 41 has received an input signal outputted from the 10-dollar BET switch 27S when the 10-dollar BET button 27 is pressed.

When the main CPU 41 determines that the 10-dollar BET button 27 has been turned ON, the main CPU subtracts 10 dollars from the amount of credit stored in the RAM 43 (step S25). When the betted amount is larger than the amount of credit stored in the RAM 43, the main CPU 41 returns the processing to step S10 without making a subtraction from the amount of credit.

Next, the main CPU 41 determines whether or nor the insurance flag is set (step S26).

When the main CPU 41 determines that the insurance flag is set, the main CPU 41 sets the number $C_B$ of 10-dollar BETs to $C_B$=$C_B$+1 in the number-of-BETs storage area in the RAM 43 (step S27).

When the main CPU 41 determines that the insurance flag is not set in step S26 or after the processing of step S27, the main CPU 41 completes the present subroutine.

When the main CPU 41 determines that the 10-dollar BET button 27 has not been turned ON in step S24, the main CPU 41 determines whether or not the 25-dollar BET button 28 has been turned ON (step S28). In this processing, the main CPU 41 determines whether or not the main CPU 41 has received an input signal outputted from the 25-dollar BET switch 28S when the 25-dollar BET button 28 is pressed.

When the main CPU 41 determines that the 25-dollar BET button 28 has not been turned ON, the main CPU 41 returns the processing to step S20.

When the main CPU 41 determines that the 25-dollar BET button 28 has been turned ON, the main CPU 41 subtracts 25 dollars from the amount of credit stored in the RAM 43 (step S29). When the betted amount is larger than the amount of credit stored in the RAM 43, the main CPU 41 returns the processing to step S10 without making a subtraction from the amount of credit.

Next, the main CPU 41 determines whether or not the insurance flag is set (step S30).

When the main CPU 41 determines that the insurance flag is set, the main CPU 41 sets the number $C_C$ of 25-dollar BETs to $C_C$=$C_C$+1 in the number-of-BETs storage area in the RAM 43 (step S31).

When the main CPU 41 determined that the insurance flag is not set in step S30 or after the processing of step S31, the main CPU 41 completes the present subroutine.

As above, the BET reception processing conducted in step S10 in FIG. 4 has been described with reference to FIGS. 6 and 7.

Subsequently, insurance payout processing conducted in step S15 in FIG. 4 is described with reference to FIGS. 8 and 9.

Figure 8:
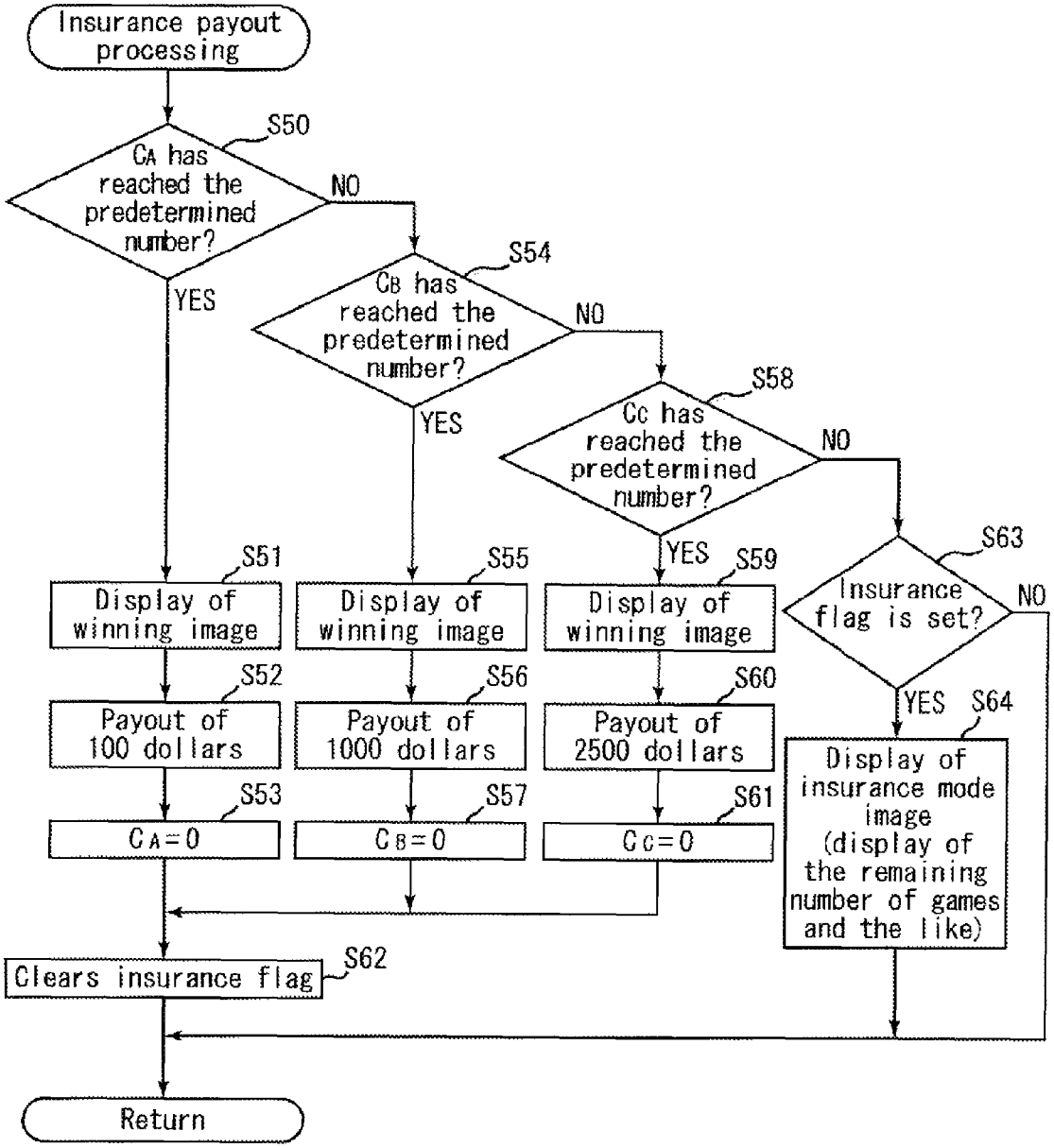
FIG. 8 is a flowchart illustrating a subroutine of insurance payout processing according to the first embodiment.

FIG. 8 is a flowchart illustrating a subroutine of insurance payout processing according to the first embodiment.

Figure 9A:
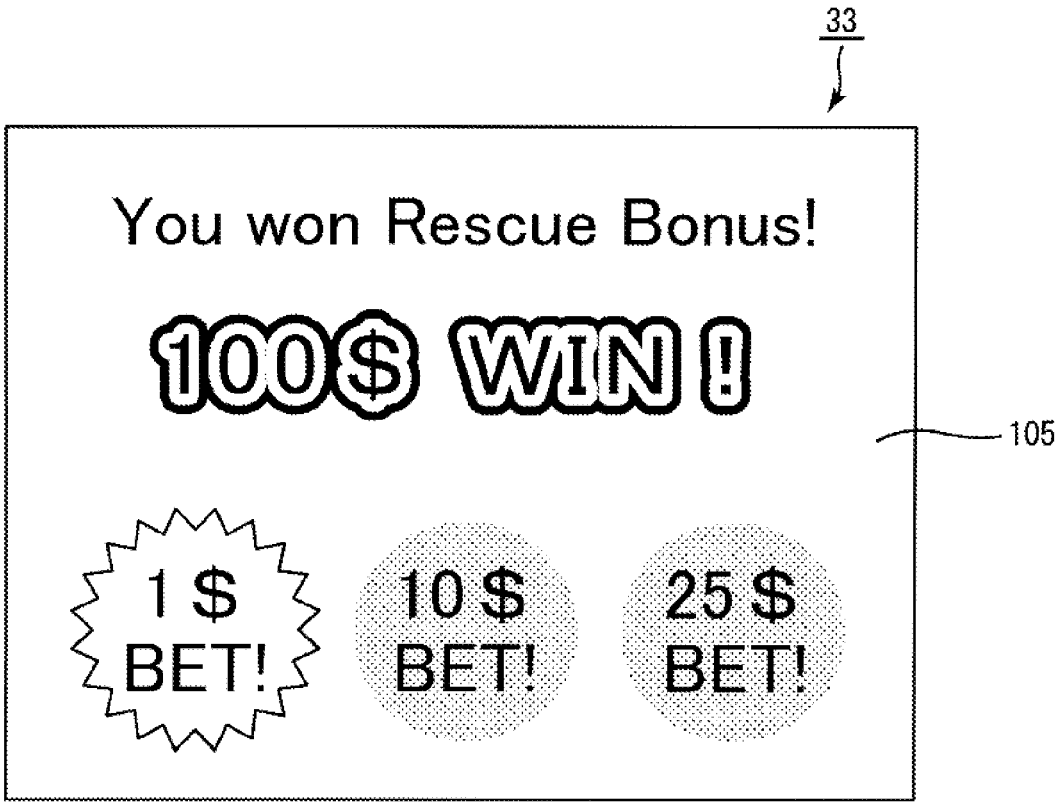
FIG. 9A is a view illustrating an exemplary image to be displayed to an upper image display panel.
Figure 9B:
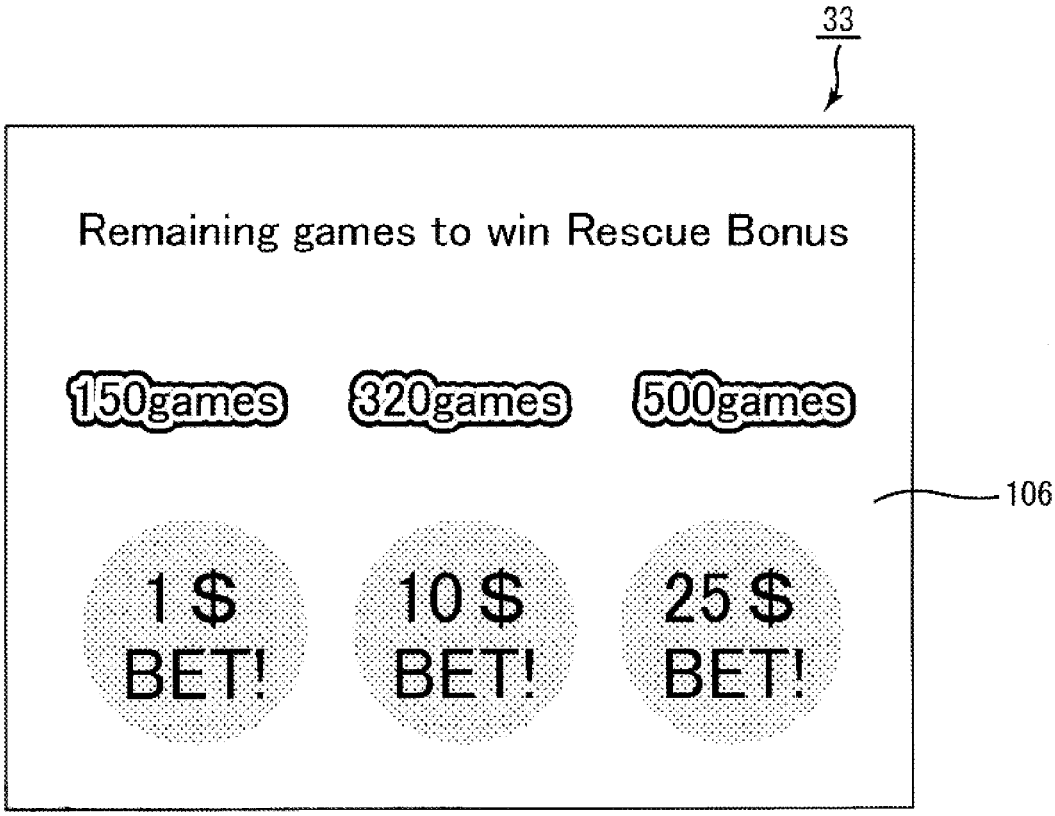
FIG. 9B is another view illustrating an exemplary image to be displayed to an upper image display panel.

FIGS. 9A and 9B are views each illustrating an exemplary image to be displayed to an upper image display panel.

First, the main CPU 41 determines whether or not the number $C_A$ of 1-dollar BETs has reached the predetermined number of times (500) based on the data on the number $C_A$ of 1-dollar BETs (step S50).

When the main CPU 41 determines that the number $C_A$ of 1-dollar BETs has reached the predetermined number of times (500), the main CPU 41 displays a winning image to the upper image display panel 33 (step S51). The winning image is displayed when the number $C_A$ of 1-dollar BETs, the number $C_B$ of 10-dollar BETs, or the number $C_C$ of 25-dollar BETs has reached the predetermined number of times (500) FIG. 9A shows a winning image 105 displayed when the number $C_A$ of 1-dollar BETs has reached the predetermined number of times (500).

Next, the main CPU 41 conducts processing for paying out the game media corresponding to the amount of insurance payout (100 dollars, see FIG. 1B) which is set for the 1-dollar BET button 26 (step S52).

Then, the main CPU 41 sets the number $C_A$ of 1-dollar BETs to $C_A$=0 in the number-of-BETs storage area in the RAM 43 (step S53).

When the main CPU 41 determines that the number $C_A$ of 1-dollar BETs has not reached the predetermined number of times (500), the main CPU 41 determines whether or not the number $C_B$ of 10-dollar BETs has reached the predetermined number of times (500 times) based on the data on the number $C_B$ of 10-dollar BETs (step S54).

When the main CPU 41 determines that the number $C_B$ of 10-dollar BETs has reached the predetermined number of times (500), the main CPU 41 displays the winning image to the upper image display panel 33 (step S55).

Next, the main CPU 41 conducts processing for paying out the game media corresponding to the amount of insurance payout (1000 dollars, see FIG. 1B) which is set for the 10-dollar BET button 27 (step S56).

Then, the main CPU 41 sets the number $C_B$ of 10-dollar BETs to $C_A$=0 in the number-of-BETs storage area in the PAM 43 (step S57).

When the main CPU 41 determines that the number $C_B$ of 10-dollar BETs has not reached the predetermined number of times (500), the main CPU 41 determines whether or not the number $C_C$ of 25-dollar BETS has reached the predetermined number of times (500) based on the data on the number $C_C$ of 25-dollar BETs (step S58).

When the main CPU 41 determines that the number $C_C$ of 25-dollar BETs has reached the predetermined number of times (500), the main CPU 41 displays the winning image to the upper image display panel 33 (step S59).

Next, the main CPU 41 conducts processing for paying out the game media corresponding to the amount of insurance payout (2500 dollars, see FIG. 15) set for the 25-dollar BET button 28 (step S60).

Then, the main CPU 41 sets the number $C_C$ of 25-dollar BETs to $C_C$=0 in the number-of-BETs storage area in the RAM 43 (step S61).

After the processing of steps S53, S57, or S61, the main CPU 41 clears the insurance flag (step S62).

Then, the main CPU 41 completes the present subroutine.

When the main CPU 41 determines the number $C_C$ of 25-dollar BETS has not reached the predetermined number of times (500) in step S58, the main CPU 41 determines whether or not the insurance flag is set (step S63).

When the main CPU 41 determines that the insurance flag is set, the main CPU 41 displays the insurance mode image to the upper image display panel 33 (step S64). The insurance mode image shows the remaining number of times needed to reach the predetermined number of times (500) with respect to each of the number $C_A$ of 1-dollar BETS, the number $C_B$ of 10-dollar BETS, and the number $C_C$ of 25-dollar BETs. FIG. 9B shows the insurance mode image 106 as an example.

When the main CPU 41 determines that the insurance flag is not set in step S63 or after the processing of step S64, the main CPU 41 completes the present subroutine.

As above, according to the slot machine 10 of the first embodiment, the payout of the game media corresponding to the amount of insurance payout (insurance payout) is related with the following: which BET button the player has used in betting; and how many times the player has betted by using that BET input device in the past games. This allows the player to place a BET aimed at the insurance payout which may be conducted in the future, when placing a BET in each game, so that a determination made by the player in betting is allowed to have a strategy. Further, the player is allowed to consider which BET button to use to place a BET in the present game, from a long-term point of view. As a result, it is possible to enhance an attractive aspect of the game and to have the player absorbed in the game.

Further, according to the slot machine 10 of the first embodiment, when the number of times counted in association with any BET button has reached the predetermined number of times (500), the game media corresponding to the amount of insurance payout set for that BET button is offered.

Accordingly, it is possible to allow the player to think about the magnitude of the amount of insurance payout which may be offered in the future and to have a longer-term point of view.

According to the slot machine 10 of the first embodiment, which BET button is used to place a BET in each game is related to both the amount of payout in the present game and the amount of insurance payout. Accordingly, it is possible to have the player consider which BET button to use to place a BET in order to obtain the largest payout. Thus, the player is further absorbed in the game.

According to the slot machine 10 of the first embodiment, when the number of times counted in association with any BET button has reached the predetermined number of times (500), the numbers of times counted in association with the BET buttons other than that BET button are not cleared. Accordingly, even after the insurance payout is conducted based on the number of times counted in association with one BET button having reached the predetermined number of times, the insurance payout may be conducted if the number of times counted in association with another BET button has reached the predetermined number of times. This keeps an expectation of the player for receiving the profit of the insurance payout even after the insurance payout is once offered.

In the first embodiment, the case has been described where all the predetermined numbers of times set for respective BET buttons are the same. However, in the present invention, the predetermined number of times set in association with each BET button may be different from one another.

FIG. 10 shows an example of the above case.

FIG. 10 is a view illustrating an insurance table according to another embodiment.

In the insurance table shown in FIG. 10, the BET button corresponding to the larger amount of BET is associated with the smaller predetermined number of times.

Generally speaking, some players want to receive the insurance payout after playing games for a long time while limiting the amount to consume in each game, and other players want to receive the insurance payout earlier while placing BETs of the large amount in order to increase the amount of payout in each game. The present embodiment satisfies demands from both players.

Second Embodiment

The outline of a second embodiment is described with reference to FIG. 11.

FIG. 11 is a view illustrating an insurance table according to the second embodiment.

In the first embodiment, the case has been described where the insurance payout is conducted when any one of the number of times $C_A$ counted in association with the 1-dollar BET button 26, the number of times $C_B$ counted in association with the 10-dollar BET button 27, and the number of times $C_C$ counted in association with the 25-dollar BET button 28 has reached the predetermined number of times. Any one of $C_A$, $C_B$ and $C_C$ having reached the predetermined number of times corresponds to the predetermined condition of the present invention. However, the predetermined condition in the present invention is not limited to this example.

In the second embodiment, a case is described where another condition is set as the predetermined condition.

The predetermined number of times (500) is set for each BET button in the insurance table according to the first embodiment. However, the predetermined number of times is not set for each BET button in the insurance table according to the second embodiment (see FIG. 11).

In a slot machine according to the second embodiment, the insurance payout is conducted when the sum of the number of times $C_A$ counted in association with the 1-dollar BET button, the number of times $C_B$ counted in association with the 10-dollar BET button and the number of times $C_C$ counted in association with the 25-dollar BET button has reached the predetermined number of times (500).

In this case, the amount to be paid out is the amount of insurance payout set for the BET button which has been associated with the counting for the largest number of times. For example, in a case where the sum of $C_A$, $C_B$, and $C_C$ has reached 500 and $C_A$ is 80, $C_B$ is 180, and $C_C$ is 240, game media corresponding to the amount of insurance payout set for the 25-dollar BET button (2500 dollars) are paid out.

As above, the predetermined condition of the present invention adopted in the second embodiment is "when the predetermined number of times has been reached by the sum of the number of times $C_A$ counted in association with the 1-dollar BET button, the number of times $C_B$ counted in association with the 10-dollar BET button, and the number of times $C_C$ counted in association with the 25-dollar BET button, the BET button has been associated with the counting for the largest number of times".

Further, in the insurance table according to the second embodiment, the amount of insurance BET is set with respect to each BET button.

In the slot machine according to the second embodiment, the player needs to purchase a 1-dollar insurance by pressing a 1-dollar insurance BET button (not shown) in order to receive the insurance payout according to the 1-dollar BET button. The player needs to purchase a 10-dollar insurance by pressing a 10-dollar insurance BET button (not shown) in order to receive the insurance payout according to the 10-dollar BET button. The player needs to purchase a 25-dollar insurance by pressing a 25-dollar insurance BET button (not shown) in order to receive the insurance payout according to the 25-dollar BET button.

In order to purchase the 1-dollar insurance, the 10-dollar insurance, or the 25-dollar insurance, the player needs to pay the amount of insurance BET corresponding thereto.

The outline of the second embodiment has been described as above.

Hereinafter, components that are same as the components of the slot machine 10 according to the first embodiment are given the same signs in description.

Further, descriptions are omitted about the parts to which the descriptions in the first embodiment are applicable in a second embodiment.

Figure 12:
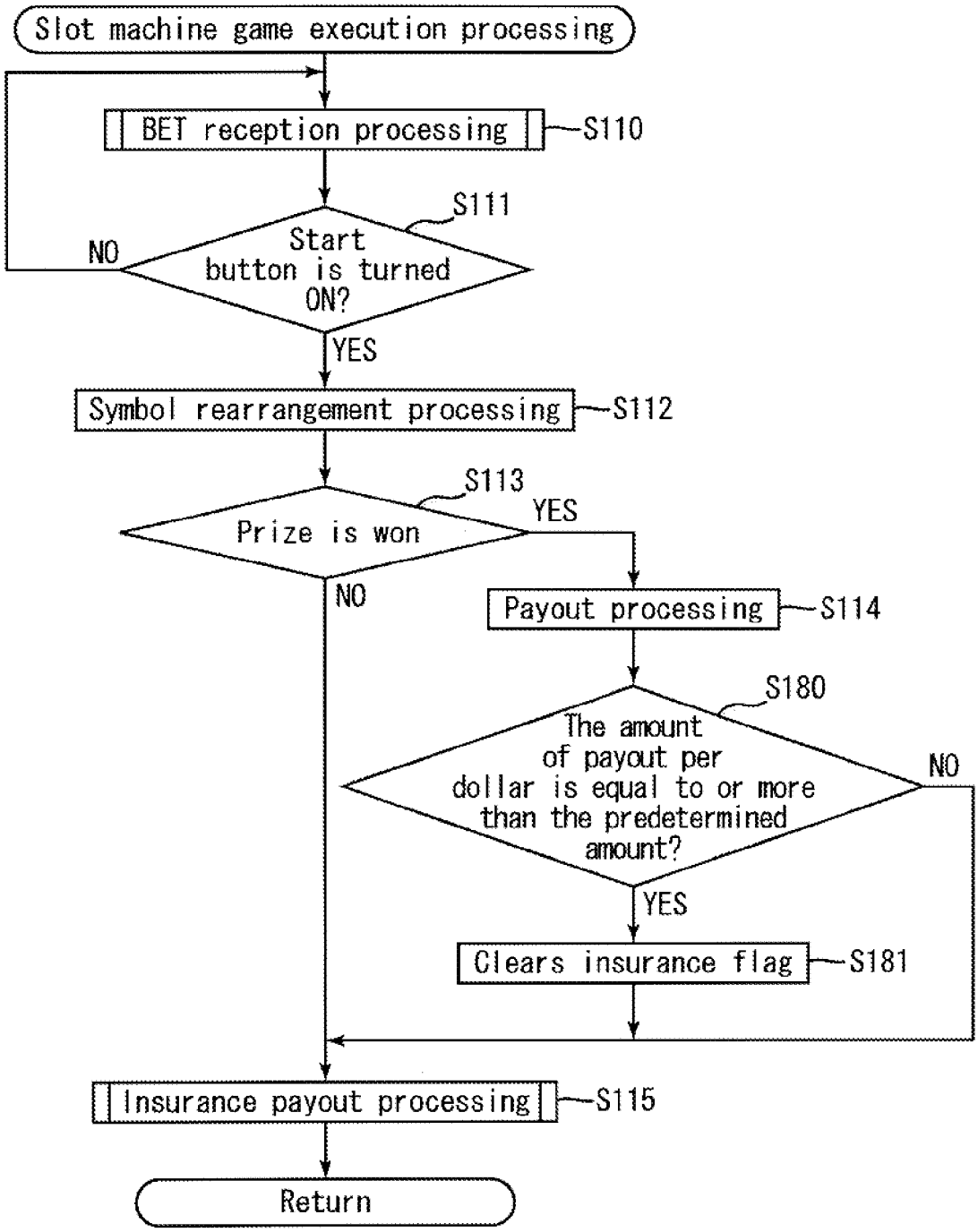
FIG. 12 is a flowchart illustrating a subroutine of slot machine game execution processing according to the second embodiment.

FIG. 12 is a flowchart illustrating a subroutine of slot machine game execution processing according to the second embodiment.

Processing of steps S110 to S115 is the same as the processing of steps S10 to S15 in FIG. 4, and therefore, the description thereof is omitted here. The description only on steps S180 and S181 is given here.

After the processing of step S114, the main CPU 41 determines whether or not the amount of payout per dollar is equal to or more than the predetermined amount (step S180). In this processing, the main CPU 41 determines whether or not the amount obtainable by subtracting the amount of payout determined in step S114 from the amount betted in step S110 is equal to or more than the predetermined amount.

When the main CPU 41 determines that the amount of payout per dollar is equal to or more than the predetermined amount, the main CPU 41 clears the insurance flag (step S181). In the second embodiment, the insurance flag includes a 1-dollar insurance flag, a 10-dollar insurance flag, and a 25-dollar insurance flag. The 1-dollar insurance flag, the 10-dollar insurance flag, and the 25-dollar insurance flag are described later.

When the main CPU 41 determines that the amount of payout per dollar is less than the predetermined amount or after the processing of step S181, the main CPU 41 shifts the processing to step S115.

As above, the slot machine 10 according to the second embodiment is configured to clear the insurance flag in the case of winning of a prize which offers the amount of payout per dollar equal to or more than the predetermined amount.

Figure 13:
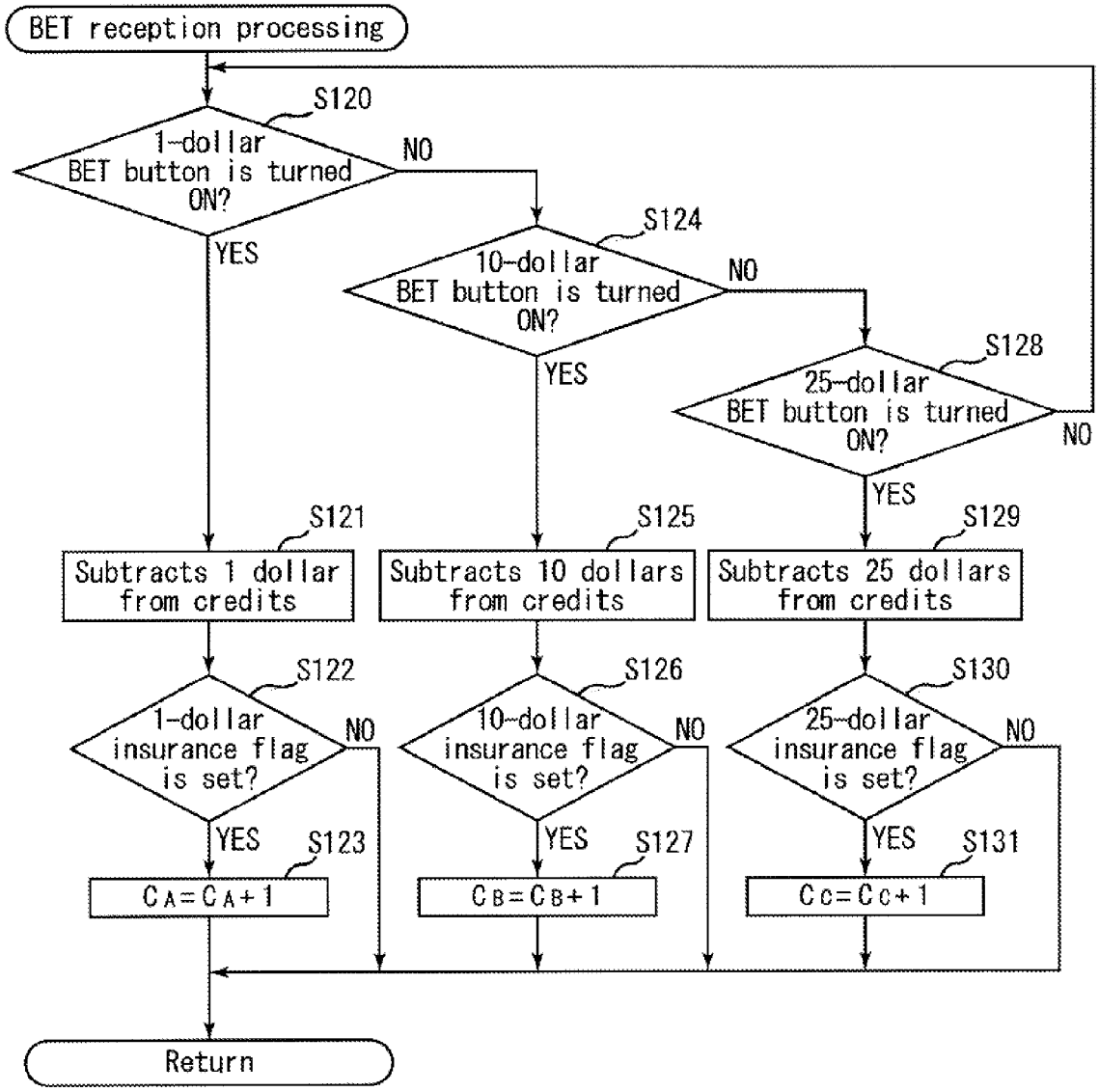
FIG. 13 is a flowchart illustrating a subroutine of BET reception processing according to the second embodiment.

FIG. 13 is a flowchart illustrating a subroutine of BET reception processing according to the second embodiment.

BET reception processing according to the second embodiment is substantially the same as the BET reception processing according to the first embodiment, and therefore, the description is given only on the different point (steps S122, S126, and S130).

In steps S22, S26, and S30, there has been described a case where the main CPU 41 determines whether or not the insurance flag is set. In contrast, in step S122 in FIG. 13, the main CPU 41 determines whether or not the 1-dollar insurance flag is set. In step S126, the main CPU 41 determines whether or not the 10-dollar insurance flag is set. Further, in step S130, the main CPU 41 determines whether or not the 25-dollar insurance flag is set.

Here, the 1-dollar insurance flag, the 10-dollar insurance flag, and the 25-dollar insurance flag are described with reference to FIG. 14.

Figure 14:
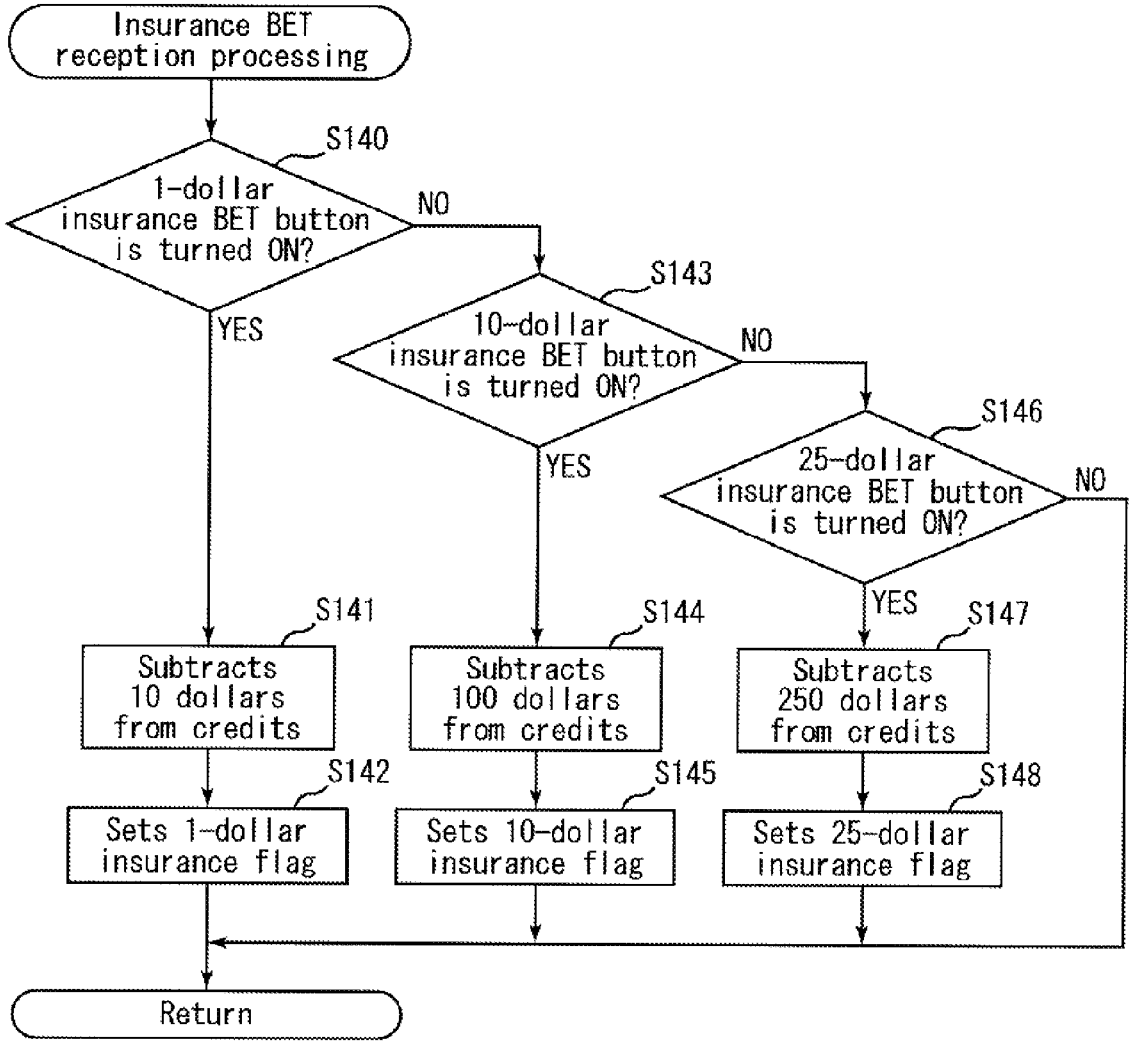
FIG. 14 is a flowchart illustrating a subroutine of insurance BET reception processing according to the second embodiment.

FIG. 14 is a flowchart illustrating a subroutine of insurance BET reception processing according to the second embodiment.

First, the main CPU 41 determines whether or not the 1-dollar insurance BET button is turned ON at a predetermined timing (step S140). In this processing, the main CPU 41 determines whether or not the main CPU 41 has received an input signal outputted from a 1-dollar insurance BET switch when the 1-dollar insurance BET button has been pressed.

When the main CPU 41 determines that the 1-dollar insurance BET button has been turned ON, the main CPU 41 subtracts 10 dollars from the amount of credit stored in the RAM 43 (step S141).

Then, the main CPU 41 sets the 1-dollar insurance flag (step S142)

After that, the main CPU 41 completes the present subroutine.

In the case where, the amount of credit stored in the RAM 43 is less than 10 dollars in step S141, the main CPU 41 completes the present subroutine without executing the processing of step S142.

When the main CPU 41 determines that the 1-dollar insurance BET button has not been turned ON, the main CPU 41 determines whether or not the 10-dollar insurance BET button has been turned ON (step s143). In this processing, the main CPU 41 determines whether or not the main CPU 41 has received an input signal outputted from a 10-dollar insurance BET switch when the 10-dollar insurance BET button has been pressed.

When the main CPU 41 determines that the 10-dollar insurance BET button has been turned ON, the main CPU 41 subtracts 100 dollars from the amount of credit stored in the RAM 43 (step S144).

Then, the main CPU 41 sets the 10-dollar insurance flag (step S145).

After that, the main CPU 41 completes the present subroutine.

In the case where the amount of credit stored in the RAM 43 is less than 100 dollars in step S144, the main CPU 41 completes the present subroutine without executing the processing of step S145.

When the main CPU 41 determines that the 10-dollar insurance BET button has not been turned ON, the main CPU 41 determines whether or not the 25-dollar insurance BET button has been turned ON (step s146). In this processing, the main CPU 41 determines whether or not the main CPU 41 has received an input signal outputted from a 25-dollar insurance BET switch when the 25-dollar insurance BET button has been pressed.

When the main CPU 41 determines that the 25-dollar insurance BET button has been turned ON, the main CPU 41 subtracts 250 dollars from the amount of credit stored in the RAM 43 (step S147).

Then, the main CPU 41 sets the 25-dollar insurance flag (step S148).

After that, the main CPU 41 completes the present subroutine.

In the case where the amount of credit stored in the RAM 43 is less than 250 dollars in step S147, the main CPU 41 completes the present subroutine without executing the processing of step S148.

As above, the 1-dollar insurance flag, the 10-dollar insurance flag, and the 25-dollar insurance flag have been described with reference to FIG. 14.

As shown in FIG. 13, according to the slot machine 10 of the second embodiment, the number of times $C_A$ of 1-dollar BETs is counted when the 1-dollar insurance flag is set (see steps S122 and S123). The number of times $C_B$ of 10-dollar BETs is counted when the 10-dollar insurance flag is set (see steps S126 and S127). The number of times $C_C$ of 25-dollar BETs is counted when the 25-dollar insurance flag is set (see steps S130 and S131).

Figure 15:
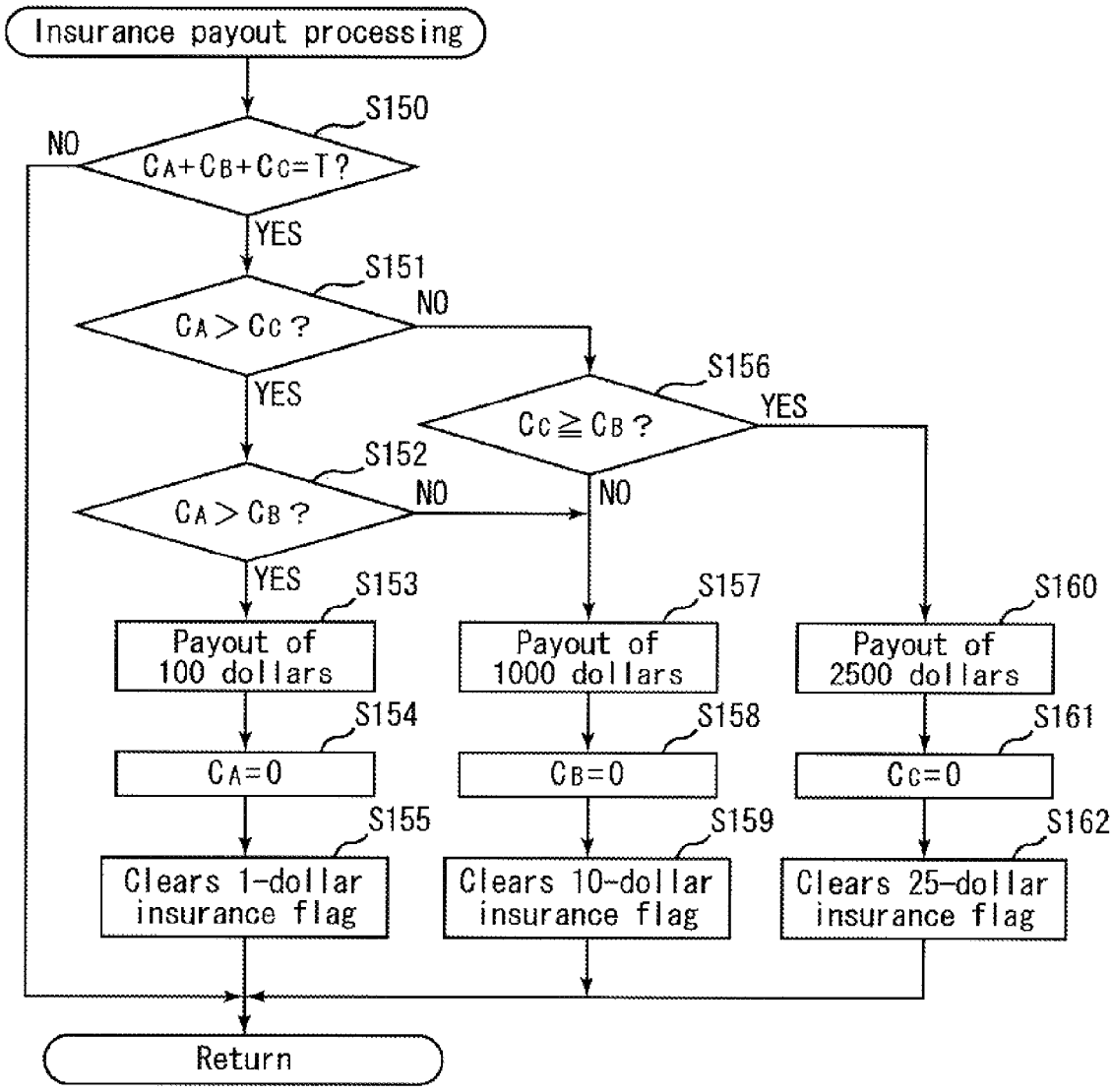
FIG. 15 is a flowchart illustrating a subroutine of insurance payout processing according to the second embodiment.

FIG. 15 is a flowchart illustrating a subroutine of insurance payout processing according to the second embodiment.

First, the main CPU 41 determines whether or not the sum of the number of times $C_A$ of 1-dollar BETs, the number of times $C_B$ of 10-dollar BETs, and the number of times $C_C$ of 25-dollar BETs has reached the predetermined number of time T (500) based on the data on the number of times $C_A$ of 1-dollar BETs, the data on the number of times $C_B$ of 10-dollar BETs, and the data on the number of times $C_C$ of 25-dollar BETs each stored in the number-of-BETs storage area in the RAM 43 (step S150).

When the main CPU 41 determines that the sum of the number of times $C_A$ of 1-dollar BETs, the number of times $C_B$ of 10-dollar BETs, and the number of times $C_C$ of 25-dollar BETs has not reached the predetermined number of times T (500), the main CPU 41 completes the present subroutine.

On the other hand, the main CPU 41 determines that the sum of the number of times $C_A$ of 1-dollar BETs, the number of times $C_B$ of 10-dollar BETs, and the number of times $C_C$ of 25-dollar BETs has reached the predetermined number of times T (500), the main CPU 41 determines whether or not the number of times $C_A$ of 1-dollar BETs is larger than the number of times $C_C$ of 25-dollar BETs (step S151).

When the main CPU 41 determines that the number of times $C_A$ of 1-dollar BETs is larger than the number of times $C_C$ of 25-dollar BETs, the main CPU 41 determines whether or not the number of times $C_A$ of 1-dollar BETs is larger than the number of times $C_B$ of 10-dollar BETs (step S152).

When the main CPU 41 determines that the number of times $C_A$ of 1-dollar BETs is larger than the number of times $C_B$ of 10-dollar BETs, the main CPU 41 pays out the game media corresponding to the amount of insurance payout (100 dollars, see FIG. 1B) set for the 1-dollar BET button 26 (step S153).

Then, the main CPU 41 sets the number of times $C_A$ of 1-dollar BETs to $C_A$=0 (step S154) and clears the 1-dollar insurance flag (step S155). After that, the main CPU 41 completes the present subroutine.

When the main CPU 41 determines that the number of times $C_A$ of 1-dollar BETs is equal to or smaller than the number of times $C_C$ of 25-dollar BETs in step S151, the main CPU 41 determines whether or not the number of times $C_C$ of 25-dollar BETs is larger than the number of times $C_B$ of 10-dollar BETs (step S156).

When the main CPU 41 determines that the number of times $C_C$ of 25-dollar BETs is smaller than the number of times $C_B$ of 10-dollar BETs in step S156, or when the main CPU 41 determines that the number of times C of 1-dollar BETs is smaller than the number of times $C_B$ of 10-dollar BETs in step S152, the main CPU 41 pays out the game media corresponding to the amount of insurance payout (1000 dollars, see FIG. 11B) set for the 10-dollar BET button 27 (step S157).

Then, the main CPU 41 sets the number of times $C_B$ of 10-dollar BETs to $C_B$=0 (step S158) and clears the 10-dollar insurance flag (step S159). After that, the main CPU 41 completes the present subroutine.

When the main CPU 41 determines that the number of times $C_C$ of 25-dollar BETs is larger than the number of times $C_B$ of 10-dollar BETs in step S156, the main CPU 41 pays out the game media corresponding to the amount of insurance payout (2500 dollars, see FIG. 11B) set for the 25-dollar BET button 28 (step S160).

Then, the main CPU 41 sets the number of times $C_C$ of 25-dollar BETS to $C_C$=0 (step S161) and clears the 25-dollar insurance flag (step S162). After that, the main CPU 41 completes the present subroutine.

As above, according to the slot machine 10 of the second embodiment, when the sum of the number of times $C_A$ counted in association with the 1-dollar BET button 26, the number of times $C_B$ counted in association with the 10-dollar BET button 27, and the number of times $C_C$ counted in association with the 25-dollar BET button 28 has reached the predetermined number of times (500), the game media corresponding to the amount of insurance set for the BET button which has been associated with the counting for the largest number of times are paid out. Thus, the player is allowed to have a longer-term point of view and the strategic aspect of the game is further enhanced.

One example is shown in the following. In a case where the current numbers of times are respectively $C_A$=190, $C_B$=50, and $C_C$=100, the player may make the below determinations:

(i) the BET by using the 1-dollar BET button 26 for 60 times causes $C_A+C_B+C_C$=500 and $C_A$ being the largest number, so that 100 dollars is obtained;

(ii) the BET by using the 10-dollar BET button 27 for 60 times causes $C_A+C_B+C_C$500 and $C_B$ being the largest number, so that 1000 dollars is obtained, which is more advantageous than (i); and (iii) the BET by using the 25-dollar BET button 28 for 60 times only causes $C_A+C_B+C_C$=500 and $C_C$ is smaller than $C_A$, so that only 100 dollars is obtained, which is disadvantageous than (i) and (ii).

As above, according to the current values of $C_A$, $C_B$, and $C_C$, the player carefully consider which button is advantageous or disadvantageous in placing a BET, which makes the player more absorbed in the game.

According to the slot machine 10 of the second embodiment, the insurance flag is cleared also in the case of winning a prize which offers the amount of payout per dollar being equal to or more than the predetermined amount. As a result, counting in association with the BET button is interrupted. Accordingly, in such a case, the player needs to purchase the insurance again by paying the amount of insurance BET in order to have the counting restarted. Thus, the gaming facility can expect the profit increase.

Further, according to the slot machine 10 of the second embodiment, all the insurance flag including the 1-dollar insurance flag, the 10-dollar insurance flag, and the 25-dollar insurance flag are cleared in the case of winning a prize which offers the amount of payout per dollar being equal to or more than the predetermined amount. Accordingly, for example, when the player has betted one dollar in a game and the prize offering the amount of payout per dollar being equal to or more than the predetermined amount is won in that game, the actual amount of payout is small. However, even in such a case, the 25-dollar insurance flag is also cleared and it is highly possible that the player feels he or she have a bad deal. The player may place a BET of the larger amount to avoid such situations. According to the slot machine 10 of the second embodiment, it is possible to encourage the player to place a BET of the larger amount by making use of the player's mental process as described above.

As above, the first and second embodiments have been described.

In the above embodiments, there has been described the case where the game media are paid out based on the number of times counted in association with the BET buttons. However, offering of the predetermined profit in the present invention is not limited to this example. For example, a gift set for each BET button may be offered.

Further, free games or bonus games may be played for the number of times corresponding to the BET button. The free game is played without a BET of game media. The bonus game is comparatively advantageous for the player. Examples thereof include a game in which the amount of payout is determined based on comparatively good odds. In this case, different odds may be set for respective BET buttons.

Third Embodiment

Figure 16:
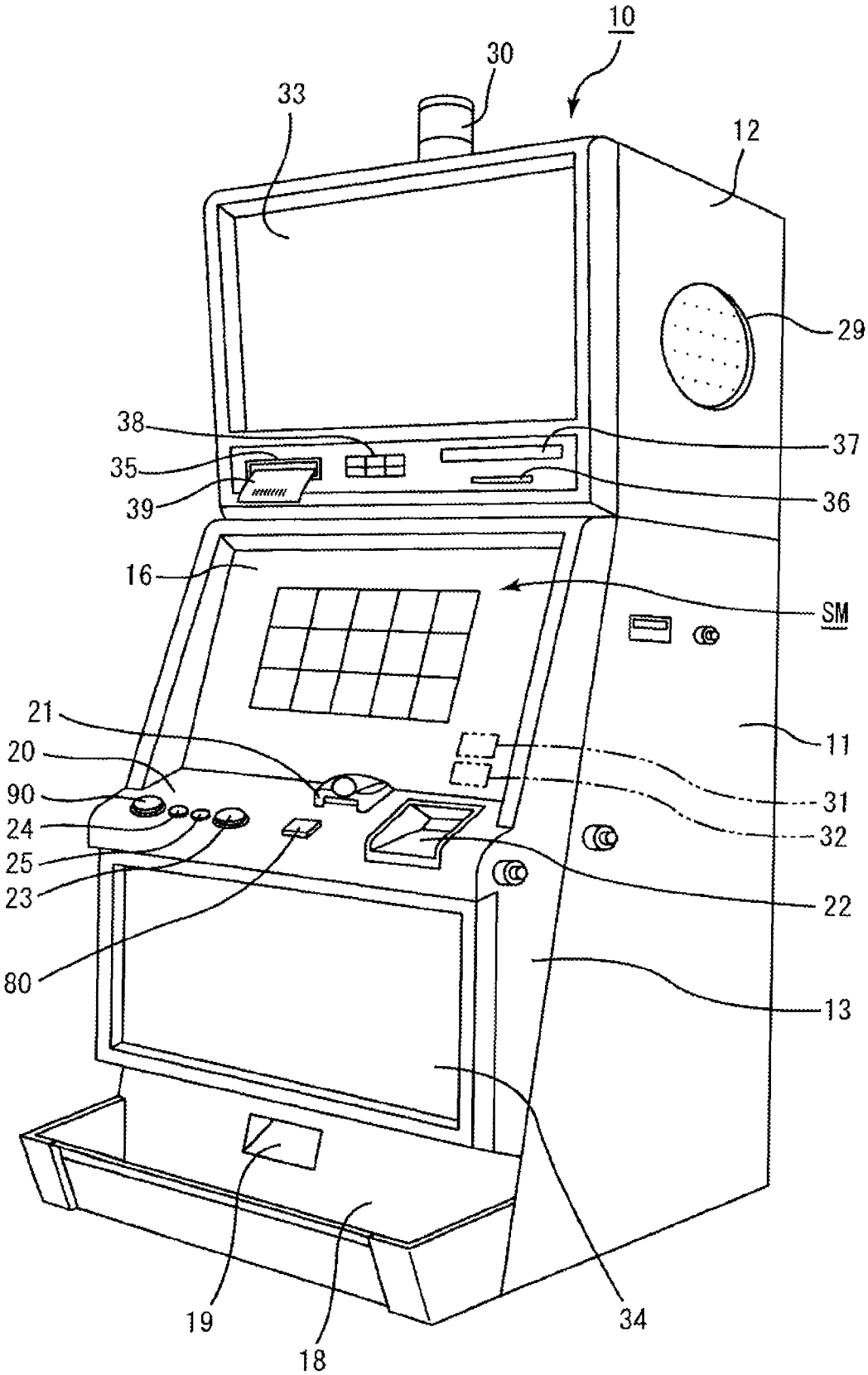
FIG. 16 is a perspective view illustrating the external appearance of a slot machine according to a third embodiment.

FIG. 16 is a perspective view illustrating the external appearance of a slot machine according to a third embodiment.

In the first and second embodiments, there has been described the case where the 1-dollar BET button 26, the 10-dollar BET button 27, and the 25-dollar BET button 28 are provided as the plurality of BET input devices.

On the contrary, in the third embodiment, there is described a case where only one BET button 80 is provided as the BET input device.

The player can bet one dollar by pressing the BET button 80 once. The player can bet 10 dollars by pressing the BET button 80 twice. The player can bet 25 dollars by pressing the BET button 80 for three times.

One dollar, 10 dollars, and 25 dollars constitute the plurality of amounts of BET of the present invention.

Figure 17:
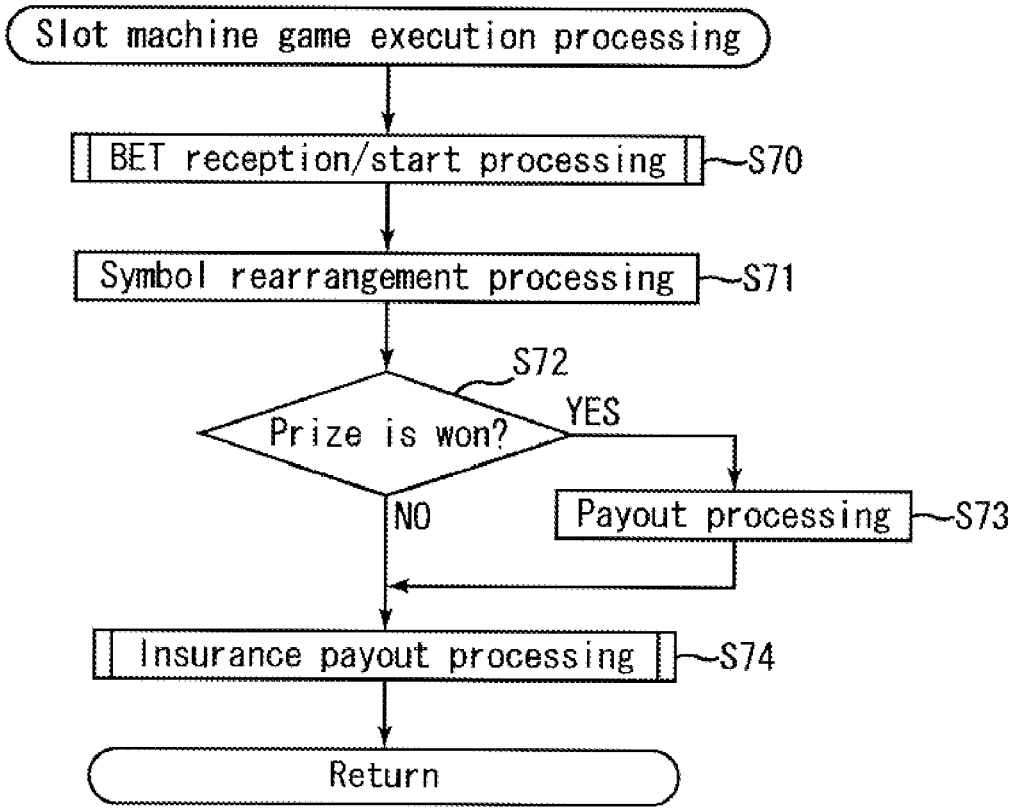
FIG. 17 is a flowchart illustrating a subroutine of slot machine game execution processing according to the third embodiment.

FIG. 17 is a flowchart illustrating a subroutine of slot machine game execution processing according to the third embodiment.

First, the main CPU 41 executes BET reception/start processing (step S70). The BET reception/start processing is described later in detail with reference to FIG. 18.

Subsequently, the main CPU 41 executes the processing of steps S71 to S74. The processing is the same as the processing of steps S12 to S15 in FIG. 4, and therefore, the description thereof is omitted here.

Figure 18:
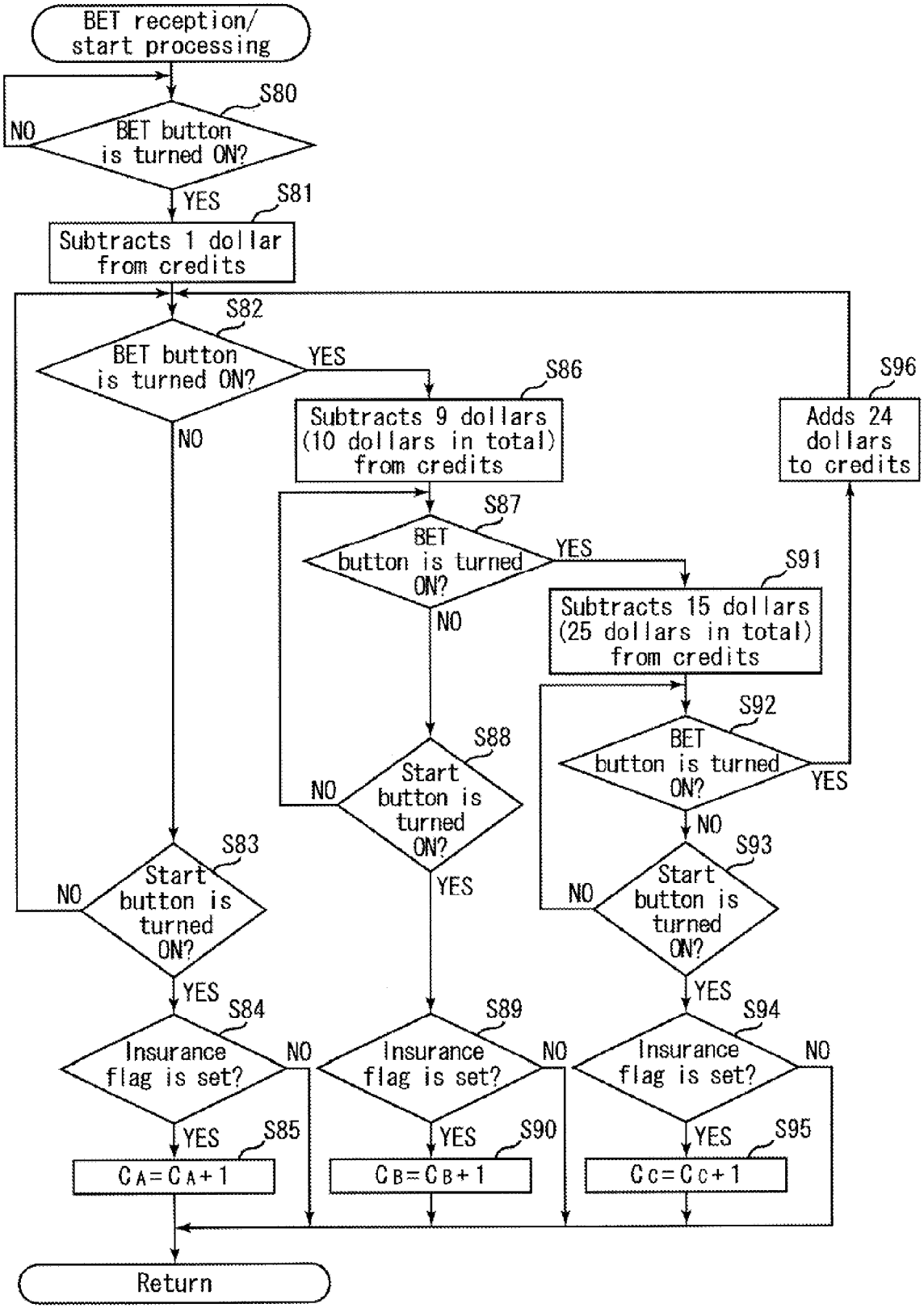
FIG. 18 is a flowchart illustrating a subroutine of BET reception/start processing according to the third embodiment.

FIG. 18 is a flowchart illustrating a subroutine of BET reception/start processing according to the third embodiment.

First, the main CPU 41 determines whether or not the BET button 80 has been turned ON (step S80). In this processing, the main CPU 41 determines whether or not the main CPU 41 has received an input signal outputted from a BET switch 80S (not shown) when the BET button 80 is pressed.

When the main CPU 41 determines that the BET button 80 has not been turned ON, the main CPU 41 shifts the processing to step S80.

On the other hand, when the main CPU 41 determines that the BET button 80 has been turned ON, the main CPU 41 subtracts one dollar from the amount of credit stored in the RAM 43 (step S81). In a case where the amount of credit stored in the RAM 43 is less than one dollar, the main CPU 41 returns the processing to step S80 without making a subtraction from the amount of credit stored in the RAM 43.

Next, the main CPU 41 determines whether or not the BET button 80 has been turned ON again (step S82).

When the main CPU 41 determines that the BET button 80 has not been turned ON, the main CPU 41 determines whether or not the start button 23 has been turned ON (step S83). The processing is the same as the processing of step S11 in FIG. 4, and therefore, the description thereof is omitted here.

When the main CPU 41 determines that the start button 23 has not been turned ON, the main CPU 41 returns the processing to step S82.

On the other hand, when the main CPU 41 determines that the start button 23 has been turned ON, the main CPU 41 determines whether or not the insurance flag is set (step S84). The description has been already given on the insurance flag with reference to FIG. 7, and therefore, the description thereof is omitted here.

When the main CPU 41 determines that the insurance flag is not set in step S84, or after the processing of step S85, the main CPU 41 completes the present subroutine.

When the main CPU 41 determines that the insurance flag is set, the main CPU 41 sets the number of times $C_A$ of 1-dollar BETs to $C_A$=$C_A$1 in the number-of-BETs storage area in the RAM 43 (step S85). The number of times $C_A$ of 1-dollar BETs is the number counted in association with one dollar as the amount of BET.

When the main CPU 41 determines that the insurance flag is not set in step S84, or after the processing of step S85, the main CPU 41 completes the present subroutine.

When the main CPU 41 determines that the BET button 80 has been turned ON in step S82, the main CPU 41 subtracts nine dollars from the amount of credit stored in the RAM 43 (step S86). In a case where the amount of credit stored in the RAM 43 is less than nine dollars, the main CPU 41 returns the processing to step S80 without making a subtraction from the amount of credit stored in the RAM 43.

By the processing of steps S81 and S86, 10 dollars in total is subtracted from the amount of credit stored in the RAM 43.

Next, the main CPU 41 determines whether or not the BET button 80 has been turned ON again (step S87).

When the main CPU 41 determines that the BET button 80 has not been turned ON, the main CPU 41 determines whether or not the start button 23 has been turned ON (step S88).

When the main CPU 41 determines that the start button 23 has not been turned ON, the main CPU 41 returns the processing to step S87.

On the other hand, when the main CPU 41 determines the start button 23 has been turned ON, the main CPU 41 determines whether or not the insurance flag is set (step S89).

When the main CPU 41 determines that the insurance flag is set, the main CPU 41 sets the number of times $C_B$ of 10-dollar BETs to $C_B$=$C_B$1 in the number-of-BETs storage area in the RAM 43 (step S90). The number of times $C_B$ of 10-dollar BETs is the number counted in association with 10 dollars as the amount of BET.

When the main CPU 41 determines that the insurance flag is not set in step S89, or after the processing of step S90, the main CPU 41 completes the present subroutine.

When the main CPU 41 determines that the BET button 80 has been turned ON in step S87, the main CPU 41 subtracts 15 dollars from the amount of credit stored in the RAM 43 (step S91). In a case where the amount of credit stored in the RAM 43 is less than 15 dollars, the main CPU 41 returns the processing to step S80 without making a subtraction from the amount of credit stored in the RAM 43.

By the processing of steps S81, S86, and S91, 25 dollars in total is subtracted from the amount of credit stored in the RAM 43.

Next, the main CPU 41 determines whether or not the BET button 80 has been turned ON again (step S92).

When the main CPU 41 determines that the BET button 80 has not been turned ON, the main CPU 41 determines whether or not the start button 23 has been turned ON (step S93).

When the main CPU 41 determines that the start button 23 has not been turned ON, the main CPU 41 returns the processing to step S92.

On the other hand, when the main CPU 41 determines that the start button 23 has been turned ON, the main CPU 41 determines whether or not the insurance flag is set (step S94).

When the main CPU 41 determines that the insurance flag is set, the main CPU 41 sets the number of times $C_C$ of 25-dollar BETs to $C_C$=$C_C$1 in the number-of-BETs storage area in the RAM 43 (step S95). The number of times $C_C$ of 25-dollar BETs is the number counted in association with 25 dollars as the amount of BET.

When the main CPU 41 determines that the insurance flag is not set in step S94, or after the processing of step S95, the main CPU 41 completes the present subroutine.

When the main CPU 41 determines that the BET button 80 has been turned ON in step S92, the main CPU 41 adds 24 dollars to the amount of credit stored in the RAM 43 (step S96). By the processing of steps S81, S86, S91, and S96, one dollar in total is subtracted from the amount of credit stored in the RAM 43.

After the processing of step S96, the main CPU 41 returns the processing to step S82.

As above, according to the slot machine 10 of the third embodiment, a player can place a BET of one dollar, 10 dollars, or 25 dollars by using a single button named the BET button 80. Accordingly, the number of components for the slot machine is reduced compared to the case where a plurality of BET buttons are provided, which reduces production cost of the slot machine.

Generally speaking, many input devices may make the player find an operation of the input devices complicated. However, the slot machine 10 according to the third embodiment can lower such probability.

Although the present invention has been described with reference to embodiments thereof, these embodiments merely illustrate concrete examples, not restrict the present invention. The concrete structures of respective means and the like can be designed and changed as required. Furthermore, there have been merely described most preferable effects of the present invention, as the effects of the present invention, in the embodiments of the present invention. The effects of the present invention are not limited to those described in the embodiments of the present invention.

Further, in the aforementioned detailed description, characteristic portions have been mainly described, for ease of understanding the present invention. The present invention is not limited to the embodiments described in the aforementioned detailed description, but can be also applied to other embodiments over a wider range of applications. Further, the terms and phrases used in the present specification have been used for clearly describing the present invention, not for limiting the interpretation of the present invention. Further, those skilled in the art will easily conceive other structures, systems, methods and the like which are included in the concept of the present invention, from the concept of the present invention described in the present specification. Accordingly, the description of the claims is intended to include equivalent structures that fall within the technical scope of the invention. Further, the abstract aims at enabling engineers and the like who belong to the present technical field but are not familiar with the patent office and public institutions, the patent, law terms and technical terms to immediately understand the technical content and the essence of the present application through brief studies. Accordingly, the abstract is not intended to restrict the scope of the invention which should be evaluated from the description of the claims. It is desirable that literatures and the like which have been already disclosed are sufficiently studied and understood, in order to sufficiently understand the objects of the present invention and the specific effects of the present invention.

In the aforementioned detailed description, there have been described processing to be executed by computers. The aforementioned description and expressions have been described for the sake of enabling those skilled in the art to understand the present invention most effectively. In the present specification, each step for deriving a single result should be understood to be self-consistent processing. Further, each step includes transmission, reception, recording and the like of electric or magnetic signals. Although, in the processing at each step, such signals have been expressed as bits, values, symbols, characters, terms, numerical characters and the like, it should be noticed that they have been merely used for convenience of description. Further, although the processing at each step was described using expressions common to human behaviors in some cases, the processing described in the present specification are to be executed by various types of devices, in principle. Further, other structures required for conducting each step will be apparent from the aforementioned description.

What is claimed as new and desired to be secured by Letters Patent of the United States is:

1. A slot machine comprising:

a plurality of bet input devices, including a first bet input device and a second bet input device, with which game media in different amounts can be betted;

a symbol display capable of variably displaying a plurality of symbols; and a controller, said controller programmed to execute the processing of:

(A) receiving an input of a bet from one of said plurality of bet input devices, the bet corresponding to an amount of game media betted;

(B) variably displaying and then stop-displaying said plurality of symbols to said symbol display after the input of the bet in said processing (A), determining an amount of payout based on the amount of the game media betted in said processing (A) and either a stop-displayed symbol or a combination of stop-displayed symbols, and paying out game media in an amount corresponding to the determined amount of payout;

(C) counting a first number corresponding to the number of times that a bet has been inputted using the first bet input device, and separately counting a second number corresponding to the number of times that a bet has been inputted using the second bet input device; and (D) offering a first predetermined profit when the first number counted in said processing (C) has reached a first predetermined number, and separately offering a second predetermined profit when the second number counted in said processing (C) has reached a second predetermined number, wherein the first predetermined profit is greater than the second predetermined profit.

2. The slot machine according to claim 1,
wherein
said controller is further programmed to execute the processing of:
(E) resetting the first number counted in said processing (C) when the first predetermined profit is offered in said processing (D), and resetting the second number counted in said processing (C) when the second predetermined profit is offered in said processing (D).

3. A slot machine comprising:
a plurality of bet input devices with which game media in different amounts can be betted, the plurality of bet input devices including a first bet input device configured to receive a first bet amount and a second bet input device configured to receive a second bet amount, wherein the first bet amount is greater than the second bet amount;
a symbol display capable of variably displaying a plurality of symbols; and
a controller,
said controller programmed to executed the processing of:
(A) receiving an input of a bet from one of said plurality of bet input devices, the bet corresponding to an amount of game media betted;
(B) variably displaying and then stop-displaying said plurality of symbols to said symbol display after the input of the bet in said processing (A),
determining an amount of payout based on the amount of the game media betted in said processing (A) and either a stop-displayed symbol or a combination of stop-displayed symbols, and
paying out game media in an amount corresponding to the determined amount of payout;
(C) counting a first number corresponding to the number of times that the first bet amount has been inputted using the first bet input device, and separately counting a second number corresponding to the number of times that the second bet amount has been inputted using the second bet input device; and
(D) offering a first predetermined profit set for the first bet input device, when the first number counted in said processing (C) satisfies a first predetermined condition, and separately offering a second predetermined profit for the second bet input device, when the second number counted in said processing (C) satisfies a second predetermined condition, wherein the first predetermined profit is greater than the second predetermined profit.

4. The slot machine according to claim 3,
wherein
said processing (D) includes
paying out game media in an amount corresponding to the first predetermined profit, when the first number counted in said processing (C) satisfies the first predetermined condition, and paying out game media in an amount corresponding to the second predetermined profit, when the second number counted in said processing (C) satisfies the second predetermined condition.

5. The slot machine according to claim 3,
wherein
said controller is further programmed to execute the processing of:
(E) resetting the first number counted in said processing (C) when the first predetermined profit is offered in said processing (D), and resetting the second number counted in said processing (C) when the second predetermined profit is offered in said processing (D).

6. A control method of a slot machine, said control method comprising the steps of:
(A) receiving an input of a bet from one of a plurality of bet input devices with which game media in different amounts can be betted, the plurality of bet input devices including a first bet input device and a second bet input device;
(B) variably displaying and then stop-displaying a plurality of symbols to a symbol display after the input of the bet in said step (A),
determining an amount of payout based on the amount of the game media betted in said step (A) and either a stop-displayed symbol or a combination of stop-displayed symbols, and
paying out game media in an amount corresponding to the determined amount of payout;
(C) counting a first number corresponding to the number of times that a bet has been inputted using the first bet input device, and separately counting a second number corresponding to the number of times that a bet has been inputted using the second bet input device; and
(D) offering a first predetermined profit when the first number counted in said step (C) has reached a first redetermined number, and separately offering a second predetermined profit when the second number counted in said step (C) has reached a second predetermined number, wherein the first predetermined profit is greater than the second predetermined profit.

7. A control method of a slot machine, said control method comprising the steps of:
(A) receiving an input of a bet from one of a plurality of bet input devices with which game media in different amounts can be betted, said plurality of bet input devices including a first bet input device configured to receive a first bet amount and a second bet input device configured to receive a second bet amount, wherein the first bet amount is greater than the second bet amount;
(B) variably displaying and then stop-displaying a plurality of symbols to a symbol display after the input of the bet in said step (A),
determining an amount of payout based on the amount of the game media betted in said step (A) and either a stop-displayed symbol or a combination of stop-displayed symbols, and
paying out game media in an amount corresponding to the determined amount of payout;
(C) counting a first number corresponding to the number of times that the first bet amount has been inputted using the first bet input device, and separately counting a second number corresponding to the number of times that the second bet amount has been inputted using the second bet input device; and
(D) offering a first predetermined profit for the first bet input device, when the first number counted in said step (C) has satisfied a first predetermined condition, and separately offering a second predetermined profit for the second bet input device, when the second number counted in said step (C) has satisfied a second predetermined condition, wherein the first predetermined profit is greater than the second predetermined profit.

8. A slot machine for running a game, the slot machine comprising:
a bet input device with which game media in an amount corresponding to one of a plurality of bet amounts can be betted, the plurality of bet amounts including a first bet amount and a second bet amount;
a symbol display capable of variably displaying a plurality of symbols;

a storage device for storing the number of times that the game is run, for each of the plurality of bet amounts; and a controller, said controller programmed to execute the processing of:

(A) receiving an input of a bet amount from said bet input device;

(B) running the game, including the step of variably displaying and then stop-displaying said plurality of symbols to said symbol display after the input of the bet amount in said processing (A), determining an amount of payout based on the amount of the game media betted in said processing (A) and either a stop-displayed symbol or a combination of stop-displayed symbols, and paying out, in a predetermined case, game media in the determined amount;

(C) counting a first number corresponding to the number of times that the bet amount received in said processing (A) is equal to the first bet amount and storing the first number device, and separately counting a second number corresponding to the number of times that the bet amount received in said processing (A) is equal to the second bet amount and storing the second number in the storage device; and (D) offering a first predetermined profit when the first number counted in said processing (C) has reached a first predetermined number, and separately offering a second predetermined profit when the second number counted in said processing (C) has reached a second predetermined number, wherein the first predetermined profit is greater than the second predetermined profit.

9. A control method of a slot machine for running a game, said control method comprising the steps of:

(A) receiving an input of a bet amount from a bet input device with which game media in an amount corresponding to one of a plurality of bet amounts can be betted, the plurality of bet amounts including a first bet amount and a second bet amount;

(B) running the game, including the step of variably displaying and then stop-displaying a plurality of symbols to a symbol display after the input of the bet amount in said step (A), determining an amount of payout based on the amount of the game media betted in said step (A) and either a stop-displayed symbol or a combination of stop-displayed symbols, and paying out, in a predetermined case, game media in the determined amount;

(C) counting a first number corresponding to the number of times that the bet amount received in said step (A) is equal to the first bet amount and storing the first number in a storage device, and separately counting a second number corresponding to the number of times that the bet amount received in said step (A) is equal to the second bet amount and storing the second number in the storage device; and (D) offering a first predetermined profit when the first number counted in said step (C) has reached a first predetermined number, and separately offering a second predetermined profit when the second number counted in said step (C) has reached a second predetermined number, wherein the first predetermined profit is greater than the second predetermined profit.

* * * * *